US007278604B1

(12) United States Patent
Constantino

(10) Patent No.: US 7,278,604 B1
(45) Date of Patent: Oct. 9, 2007

(54) MULTI-USE DISPENSING STAND

(76) Inventor: Valentino John Constantino, 23 Appletree La., Clifton Park, NY (US) 12065

( * ) Notice: Subject to any disclaimer, the term of this patent is extended or adjusted under 35 U.S.C. 154(b) by 365 days.

(21) Appl. No.: 10/822,967

(22) Filed: Apr. 13, 2004

Related U.S. Application Data

(63) Continuation-in-part of application No. 10/082,895, filed on Feb. 26, 2002, now abandoned.

(60) Provisional application No. 60/277,088, filed on Mar. 19, 2001.

(51) Int. Cl.
*B65H 16/02* (2006.01)

(52) U.S. Cl. ..... 242/597.7; 242/403; 242/557; 242/560.2; 242/594; 242/596.8; 242/597.8

(58) Field of Classification Search ..... 242/597.7, 242/560, 560.2, 594, 599.4, 597.8, 598.5, 242/596.8, 422.4, 403, 557
See application file for complete search history.

(56) References Cited

U.S. PATENT DOCUMENTS

| | | | | |
|---|---|---|---|---|
| 1,259,007 | A * | 3/1918 | Fifield | 242/597.7 |
| 2,359,604 | A | 10/1944 | Atwood | |
| 2,695,208 | A | 11/1954 | Graham | |
| 2,991,951 | A | 7/1961 | Carroll | |
| 3,316,040 | A | 4/1967 | McGann | |
| 3,484,052 | A | 12/1969 | Clarke | |
| 4,030,676 | A | 6/1977 | Bardsley | |
| 4,042,159 | A | 8/1977 | Tucky | |
| 4,124,259 | A * | 11/1978 | Harris | 242/560 |
| 4,177,958 | A | 12/1979 | Poole | |
| 4,191,317 | A | 3/1980 | Harkins | |
| 4,684,075 | A | 8/1987 | Francis | |
| 4,765,475 | A | 8/1988 | Kaysserian | |
| 4,844,368 | A | 7/1989 | Hu | |
| 5,040,679 | A | 8/1991 | Rehmann | |
| 5,114,006 | A | 5/1992 | Wilk | |
| 5,301,888 | A * | 4/1994 | Danzi | 242/560 |
| 5,305,937 | A * | 4/1994 | Barnett | |
| 5,456,356 | A | 10/1995 | Kurzawa | |
| 5,887,818 | A | 3/1999 | Kelley | |
| 5,924,566 | A | 7/1999 | Gibbs | |
| 5,984,100 | A | 11/1999 | Ramsey et al. | |
| 6,047,920 | A | 4/2000 | Dearwester et al. | |
| 6,290,169 | B1 | 9/2001 | Hartley | |
| 6,302,350 | B1 | 10/2001 | Burrell et al. | |
| 6,422,503 | B1 * | 7/2002 | Hoo Kong | 242/597.7 |

* cited by examiner

*Primary Examiner*—William A. Rivera
(74) *Attorney, Agent, or Firm*—John W. LaBatt; Hoffman, Warnick & D'Alessandro LLC

(57) ABSTRACT

A multiple-type paper product dispensing mobile stand with mini-table and storage is provided. The invention can be configured in various dispensing arrangements for dispensing one or more paper products comprising paper towel rolls, toilet tissue rolls, and/or a box of paper facial pop-up tissue sheets. To this extent, one or more dispensing arrangements may incorporate an open roll holder, a hanging roll holder, and/or a web tear plate, each of which is unique to this invention. Further, various configurations allow for the storage of one or more of these products. Various embodiments of the invention also provide user conveniences such as a mini-table, wheel caster leg assemblies, and lifting knobs.

28 Claims, 10 Drawing Sheets

MULTI-USE DISPENSING STAND

CROSS-REFERENCE TO RELATED APPLICATIONS

This application is a continuation-in-part of U.S. patent application Ser. No. 10/082,895, filed on Feb. 26, 2002 now abandoned, which claims the benefit of U.S. Provisional Application No. 60/277,088 filed on Mar. 19, 2001, titled "Multiple Type Paper Dispensing Mobile Stand with Mini-Table and Storage", inventor Valentino John Constantino, each of which is hereby incorporated herein by reference.

BACKGROUND OF THE INVENTION

1. Technical Field

This invention relates to paper dispensers, specifically to such dispensers used for multiple dispensing of one or more types of paper products together with unique convenience and flexibility available to the user.

2. Background Art

Prior Art is reviewed and given consideration through the following U.S. patents showing various paper dispensers. The most basic way of dispensing toilet roll paper, is the concept of the roll itself and that roll setting on end, either on the floor or on the toilet water closet waiting to be used. Also, the concept of storing extra rolls, almost always on end on top of each other, either on a shelf or in a cabinet or in a dispensing device itself, available when needed, is desirable. In addition, several types of paper products are sometimes needed in one location, if they are available from one dispensing device it would be convenient and desirable to users. This is where the multi-functionality of a dispensing device relates. Examples of universal top priority requirements expected by users include requiring an easy and foolproof way to dispense multiple paper products within one compact device; being able to handle emergencies, such as running out of paper while disposed; having to contend with a plugged toilet; needing a convenient place to set something down onto, such as a newspaper or your eye glasses; and taking on the smallest footprint of space allocation, while being as attractive and pleasing to the eye as possible. Mobility, as in the simplistic loose roll of toilet paper itself, being able to move around, from hand to hand, from floor to water closet, and so on, is also a necessary requirement. Other conveniences, such as the time clock availability, device stability, storage and a mini-table area are also requirements of importance.

Comparable technology to invention submission is available in U.S. Pat. No. 4,030,676 to Bardsley (1977), Portable Holder for Roll of Perforated Paper Towel. It was issued for a pedestal type paper toweling perforated for tear-off as individual sheets and transportable for support on any horizontal surface. Basically, this invention shows the art of vertical roll dispensing, a portable device, a base with an annual rim, and the towel roll being completely exposed during dispensing. It also shows a simplistic design, very few parts and no moving parts. The limitations of this prior art is mainly the limited dispensing of only one type of paper product. It requires to be placed on an elevated surface and has no roll braking mechanism on the arbor. Also the arbor must be made small in diameter to accommodate egg shaped roll cores, making a very loose true roll as it gets smaller in diameter, thus making the web tearing operation more difficult. The prior art uses the extended arbor as a handle to facilitate moving the device, which is not a very attractive feature. Additionally, there is no positive feature to keep the towel roll from unwinding on its own between usages and also there is no spare towel roll storage available.

The Toilet Roll Tissue Dispenser device as described in U.S. Pat. No. 4,042,159 to Tucky (1977) shows clearly a tissue tear structure which after the web is directed some distance away from the roll being dispensed, is brought passed and near a plate surface, at the end of which is an edge for the purpose of severing, by cutting or tearing, the web. In this prior art, the cutting or tearing edge does not cut a vertical web, and the web is not held by the cutting mechanism. The prior art mounts on an existing roll dispenser and does not have a braking mechanism to aid in the web tear-off operation, spare roll accommodation, or versatility in multiple paper product dispensing.

Also, U.S. Pat. No. 2,695,208 to Graham (1954) Toilet Paper Holder and U.S. Pat. No. 4,191,317 to Harkins (1980) Toilet Paper Unrolling Fixture, show tear bars similar to the above prior art, that is, the web passes away from the roll and passes over a flat paper guide. There is a difference, in that it has a tensioning flap or roll that acts as a brake. The prior patents have a tear bar or edge for enabling the user to quickly tear-off a length of paper from the roll. Also, the patent provides a web free end after the tear. Both partial roll and full roll concealment are shown. These dispensers are for single roll, horizontal dispensing. The prior art is for wall mounting, with its drawbacks of finding the right wall position and the proper room for maneuvering around it and conveniently using it. Also, the following are excluded from said device: spare product storage accommodation, mini-table, mobility of location, extraneous storage available and multiple paper product dispensing.

U.S. Pat. No. 4,844,368 to Hu (1989) Toilet Paper Case, is a toilet roll dispenser with a web tear means. It has a two edge design. The inner toothed edge acts as a brake to limit the unwinding of the paper web and an outer toothed edge acts to cut the paper web. This prior art shows the importance of the need for a brake to work in conjunction with the tear or cutting part for proper web dispensing operation, although a single edge design would be an improved simplification. The prior art deficiencies in relation to the presented new art will become clearly apparent.

U.S. Pat. No. 5,114,006 to Wilk (1992) Tool Assembly, U.S. Pat. No. 5,456,356 to Kurzawa (1995), and U.S. Pat. No. 5,924,566 to Gibbs (1999) Plunger Caddy, all show devices that store toilet basin plungers. These devices are very limited in purpose or capabilities, thus many different devices, each with specific objectives, would be required for omnibus capability requirements.

U.S. Pat. No. 5,040,679 to Rehmann (1991) Toilet Accessory for Concealing Toilet Articles, and U.S. Pat. No. 5,984,100 to Ramsey et al. (1999) Decorative Pedestal for Bathroom Accessories, both show devices that store a toilet basin plunger and toilet accessories, such as a spare roll of toilet paper. Prior art in addition, limits a conglomeration of storage inside and outside the device, and selected dispensing combinations of use.

U.S. Pat. No. 2,991,951 to Carroll (1961) Toilet Paper Container and Dispenser, U.S. Pat. No. 3,316,040 McGann (1967) Storage Unit for Tissue Rolls, and U.S. Pat. No. 3,484,052 to Clarke (1969) Paper Dispenser, all show devices that dispense toilet roll paper and offer spare roll storage. All of these devices mount onto a wall surface. Clearly, there is no perfect wall location, and many locations are very difficult to use for everyone. There is usually limited room in wall area locations, and these types of dispensers need more room then a single roll dispenser would require.

U.S. Pat. No. 4,765,475 to Kaysserian (1988) Holder and Dispenser for Multiple Rolls of Tissue, is a toilet roll dispenser with multiple rolls of tissue. The spare rolls are on the top of the active roll, and the rolls and web are positioned vertically. This device is for wall mounting and two hand web tearing. All rolls are completely contained within the device, although the top is open, and the bottom has an open area for grabbing the tail on the active roll. Wall mounting is not desirable usually due to improper location and insufficient room. Also, a lack of a web tear-plate is undesirable. This device is a single bottom dispensing type, and if used on the floor area, would not prove convenient to operate.

U.S. Pat. No. 6,047,920 to Dearwester et al. (2000) Apparatus for Dispensing Multiple Products from a Single Tissue Roll Holder, is an apparatus for dispensing multiple products from an existing spindle type single tissue roll holder. Important similarities are the following: the apparatus dispenses toilet tissue and at least one other product; it comprises a housing; the toilet roll is mounted on a spindle; and the top of the apparatus is suited for holding additional products. Finding proper location and room available for wall mounting are limiting and definitely undesirable. Lack of mobility and the open roll dispensing are not very attractive; also, there is no web tear-plate or similar mechanism available. This device is limited to horizontal dispensing in a fixed location with the necessity of using an existing dispenser.

The closest prior art to the current invention is U.S. Pat. No. 4,177,958 to Poole (1979), Toilet Paper Service Pedestal. Comparable attributes include: vertical roll dispensing; a free standing pedestal; a movable device; roll dispensing at the top of the device; dispensing through a slot; roll dispensing off of a spindle; dispensed web lengths, which are torn off from the pennant as wanted; a pedestal with the ability to hold extra rolls; an open head end and a closed foot end; an active roll, covered from view by a cap; a combination of elements or functions; an area on top of the device for placing objects; and a structure not easily tipable. Deficiencies in the device are the need of a weight for stability, the inability to dispense several types of paper products, and the need to have two parts to seal and enclose the dispensed roll, specifically the platform and a cap. There is no mini-table, no towel or facial tissue dispensing, no web tear-plate, no caster or lift knobs for ease of movement, no legs for stability, and no outer storage available. The prior art can not dispense three types of paper products at the same time. Additionally, It can not replace the old toilet roll fixture roll with a perfume tube deodorizer, and there are no conveniences such as a clock function.

The second closest prior art to the current invention is U.S. Pat. No. 5,887,818 to Kelley (1999), Device and Method for Storing Multiple Rolls of Tissue and Dispensing Tissue Therefrom. This Patent provides both product vertical roll inner storage and open outer vertical product dispensing. Also, the stored rolls are advanced into dispensing position through a movable platform. The device being in pedestal or stand form would have some mobility. The prior art will not dispense three types of paper products singularly or simultaneously; the device is unstable with the possibility of tipping over always present; and casters and lifting knobs are not incorporated to aid in mobility. There is no mini-table, no outer storage, no perfume tube deodorizer, no flexibility of use, and limited location of use. The toilet roll is exposed, and lacks attractiveness. Also, device offerings fail to include a web tear-plate, and quasi-uniform dispensing web tension ability. Restrictions in prior art in versatility, though user conveniences, also make the device undesirable overall.

The third closest prior art to the current invention is U.S. Pat. No. 5,301,888 to Danzi (1994), Storage Unit and Dispenser for Paper Product Rolls. This Patent provides both product vertical roll inner storage and open outer horizontal product dispensing. The device's construction in pedestal or stand form enables some mobility. Deficiencies include no mini-table, no outer storage capabilities, no web tear-plate, no tension control of the web, no caster and lifting knob mobility, exposed toilet roll dispensing, no time clock convenience, and single product horizontal dispensing. Tipping is also more prevalent, and there is no perfume tube deodorizer. Again, the prior art can not dispense three types of paper products singularly or all simultaneously.

Other prior art deficiencies become apparent given the specification and drawings of the multiple type paper dispensing mobile stand with mini-table and storage device herein presented.

SUMMARY OF THE INVENTION

The invention comprises an omnibus paper dispensing utility stand that can be used in a bathroom, kitchen, den, living room, workshop, office or other compatible location. In various embodiments, the invention can incorporate multiple dispensing functions and inner and outer storage areas for extra rolls, tissue boxes, a basin plunger, or for conveniently placing other extraneous items. All of this, including complete device mobility for total user location preference. The compactness of the device and the ability to make the dispensing stand attractive, as well as functional, are shown in the provided specification and drawings.

Features like: (a) the mobility of the dispensing stand; (b) the vertical web feeding of the toilet roll, the facial tissue box, and the paper towel roll; (c) the quasi uniform tension mechanisms; (d) the web holding feature; (e) the tear plate; (f) the inner and outer storage areas; (g) the time clock function; (h) the mini-table top, which serves as a placement surface, an access door to the inner chamber, and a mounting base for the large roll holder mechanism; all elaborate the cleverness, uniqueness, functionality, and simplicity of this large omnibus roll dispensing device. Additionally, the dispenser can dispense three types of paper products all simultaneously. A significant improvement to prior art has been offered by this invention, since it truly incorporates advantages and flexibility not shown or anticipated in said prior art.

Objects and advantages of the invention include: (a) to provide a dispensing stand that conceals the active toilet roll during dispensing; (b) to provide a dispensing stand that conceals the active facial tissue box during dispensing; (c) to provide a dispensing stand that, as one of its dispensing arrangements, conceals an active towel roll during dispensing; (d) to provide quasi-uniform web tension during toilet roll and paper towel dispensing, from the start of a full roll to the finished core; (e) to provide simultaneous or selective dispensing of three commonly used paper type products, that is, toilet rolls, paper towel rolls, and facial tissue sheets, all in printed and unprinted form; (f) to provide a dispensing stand that will dispense and store products of paper toilet rolls, paper towel rolls, and paper facial tissue products; (g) to provide a multi-paper product dispensing stand that incorporates a mini-table convenience; has storage compartment convenience inside and outside the device; has a time clock convenience as part of the device; has total mobility;

can dispense and store toilet paper rolls and at the same time store a basin plunger; has a unique web tear mechanism, and unique small and large roll holder dispenser assemblies; empowers the user to configure the device to suit his/her personal requirements, including the location of use; has stability, compactness, and attractiveness; has a perfume air deodorizer; and advances the art of prior dispensers; (h) to provide a toilet paper tear-plate that does not need roll perforations to function; (i) to provide other objects and advantages that become apparent from the specification and drawings.

A first aspect of the invention provides a stand for dispensing at least one paper product, the stand comprising: a hollow elongate housing configured to be disposed in an upright position, wherein the elongate housing includes: a first end configured to be a top surface when the elongate housing is disposed in the upright position; and a second end disposed opposite the first end; a mini-table top configured to removably cover the first opening; and an open roll holder assembly mounted to the mini-table top for dispensing a first paper product on the mini-table top, wherein the open roll holder assembly comprises: an open roll holder arbor; a plurality of brake and alignment discs attached to the arbor; and a sheet unwind retainer rod.

A second aspect of the invention provides a stand for dispensing a paper product, the stand comprising: a hollow elongate housing configured to be disposed in an upright position, wherein the elongate housing includes: a first end configured to be a top surface when the elongate housing is disposed in the upright position; a second end disposed opposite the first end; a first elongate aperture disposed proximate the first end, wherein the first elongate aperture is configured to dispense the paper product in a vertical direction; and a web tear plate attached proximate to the first elongate aperture, wherein the web tear plate assists in tearing and holding the dispensed paper product.

A third aspect of the invention provides a stand for dispensing a paper product, the stand comprising: a hollow elongate housing configured to be disposed in an upright position, wherein the elongate housing includes: a first end configured to be a top surface when the elongate housing is disposed in the upright position; and a second end disposed opposite the first end; a mini-table top configured to removably cover the first opening; and an open roll holder assembly mounted to the mini-table top for dispensing the paper product on the mini-table top, wherein the open roll holder assembly comprises: an open roll holder arbor; a plurality of brake and alignment discs attached to the arbor; and a sheet unwind retainer rod.

BRIEF DESCRIPTION OF THE DRAWINGS

An appreciation of other advantages of the presented dispensing stand will be apparent when the detail description is complimented by the accompanying drawings wherein.

Figure 1:
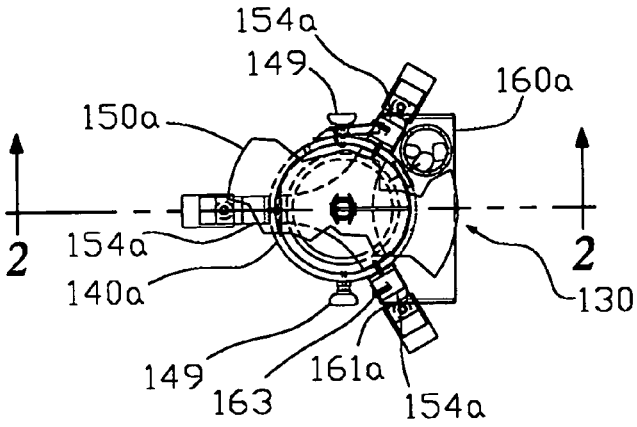
FIG. 1 is a top view of the multiple type paper dispensing mobile stand with mini-table and storage device, the preferred embodiment of the present invention, showing all apparatus parts but without plurality of products both dispensed or stored, or plurality of other storage items.
Figure 2:
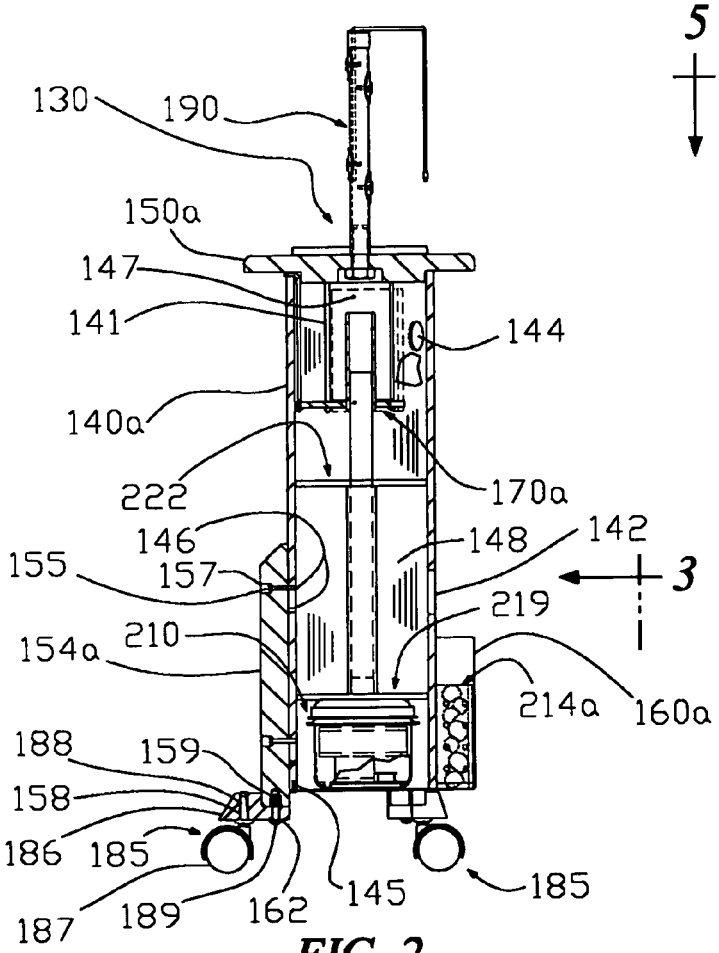
FIG. 2 shows a sectional elevation view taken along 2-2 of FIG. 1, the preferred embodiment of the present invention, showing the plurality of parts but without products and other storage items.

Note that FIGS. 1 and 2 show the multiple type paper dispensing mobile stand with mini-table storage device with all apparatus parts and without dispensing products, also without storage of any kind. Remaining Figs either show element details, assemblies, or dispensing and storage arrangements including alternate embodiments.

DETAILED DESCRIPTION OF THE INVENTION

As shown throughout the Figures, the appearance of the dispensing stand may have many forms and arrangements, but the claimed functionalities are exclusive with the current patent application. The preferred appearance along with the claimed functionalities are herein clearly illustrated.

Figure 3:
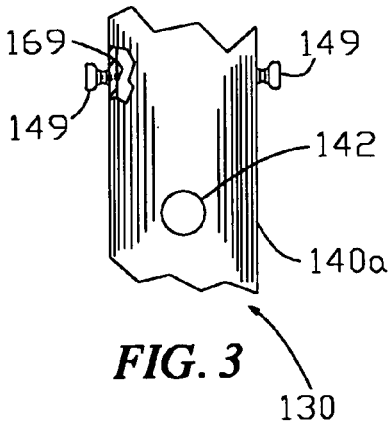
FIG. 3 shows a partial elevation view of FIG. 2, looking along line 3, at the housing feel and feed hole, and the lifting knobs.

Drawings of the preferred embodiment of the invention Multiple Type Paper Dispensing Mobile Stand with Mini-Table and Storage, show all parts or elements in drawing FIGS. 1 through 3, different arrangements of those plurality of parts are shown in FIGS. 10 through 16, FIGS. 38 through 40, and FIGS. 45 through 48; also the plurality of dispensed paper products are illustrated in FIGS. 4 through 15, FIG. 18, FIG. 29, FIGS. 31 through 40 and FIGS. 45 through 48. The detailed part descriptions are as follows:

For one embodiment shown in FIGS. 1 and 2, the basic structure of the unique dispensing stand 130 has a housing 140*a* comprising, for example, polyvinyl chloride (PVC) plastic, legs 154*a* comprising, for example, wood, mobility through lifting knobs 149 and/or caster assemblies 185, and/or a table top 150*a* comprising, for example, wood. Further, dispensing stand 130 can comprise an open roll holder 190 mounted on the outside top of the device 130, three enclosed roll holders, 170*a*, 219, and 222, nested within each other, residing in the inside of the housing chamber 148, and also of, for example, PVC construction, and/or an inner storage container 210. In operation, the mobile stand 130 dispenses one or more of a plurality of products commonly manufactured and vastly distributed such as toilet rolls, towel rolls, and/or facial pop-up tissues. There is a multitude of dispensing and storage arrangements that can be configured by the user and will be explained in significant detail as we proceed. Arrangements not shown in Figs are clearly implied and anticipated.

Figure 29:
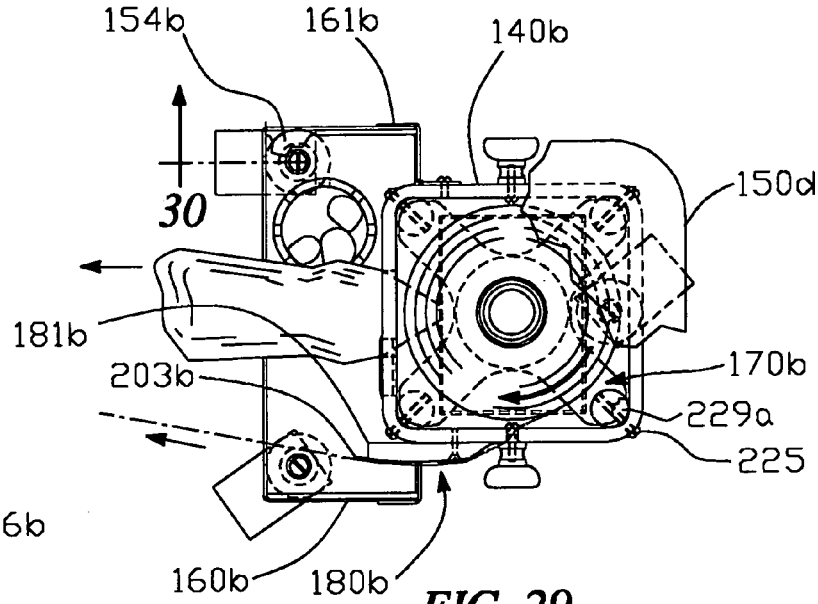
FIG. 29 is an enlarged top view showing the alternate square housing embodiment, also the alternate square mini-table top, alternate button leg, alternate square housing half basket, alternate basket mounting z clip, alternate square roll holder assembly, and alternate roll holder square housing stop embodiments are shown to suit the square housing.
Figure 31:
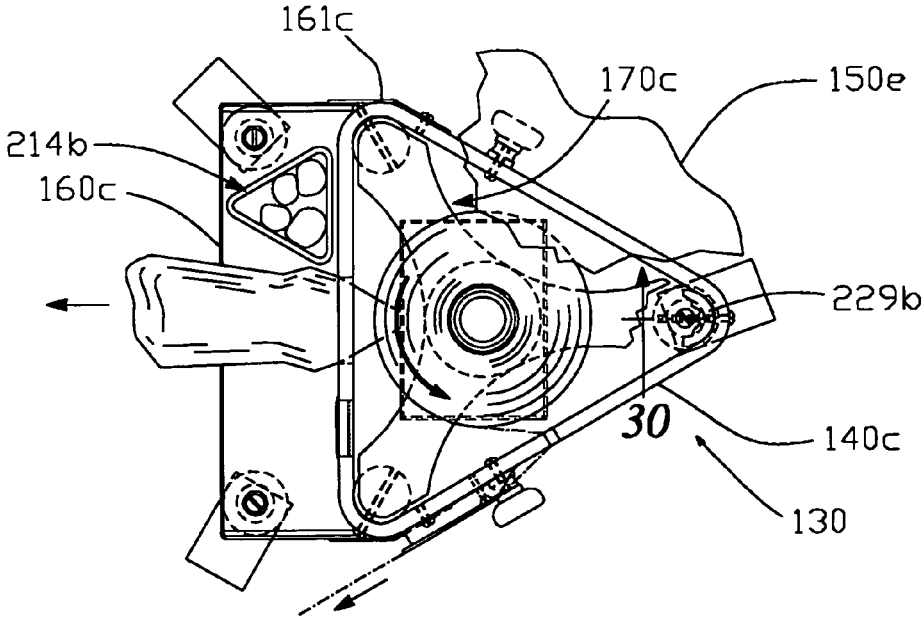
FIG. 31 shows an enlarged top view of the alternate triangular housing embodiment, also the alternate random shape mini-table top, alternate button leg, alternate triangular housing half basket, alternate basket mounting clip, alternate triangular roll holder assembly, and alternate roll holder triangular housing stop embodiments are shown to suit the triangular housing, also shown is the alternate perfume assembly.

It can be seen through the aforementioned figures, that the housing 140*a* is the main structural member of the device 130 and is constructed to suit a plurality of inner dispensed products. In one embodiment, housing 140*a* comprises a 6 inch nominal size schedule 40 PVC pipe. It is understood that housing 140*a* can comprise various sizes and shapes. For example, FIG. 29 shows an alternative square housing 140*b*, while FIG. 31 shows an alternative triangular housing 140*c*. Further, it is possible that housings 140*a-c* could be constructed of a variety of materials such as wood, plastic, metal and so on. The operation of the device 130 does not change by these embodiments.

Figure 4:
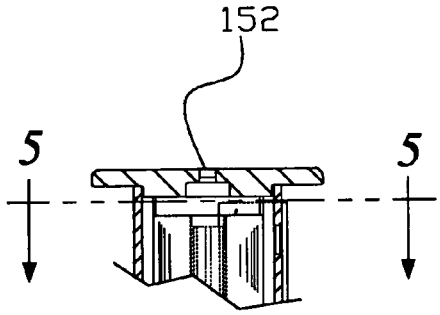
FIG. 4 shows a partially cutaway elevation view of the mini-table top without the open roll holder assembly being used and the dispensing of an active toilet paper roll.

As shown in FIGS. 2 and 4, device 130 can further include a mini-table top 150*a* that provides a convenience for a user. As shown in detail in FIG. 19, mini-table top 150*a* can include a top surface 233 that can cover the top of housing 140*a* (FIG. 2), and a bottom portion 234 that loosely engages the inside diameter of the housing 140*a*, but engages deep enough to prevent the top 150*a* from tipping. This top 150*a* provides the door or access to the housing tube inner storage and dispensing chamber 148 (FIG. 2).

It is understood that mini-table top 150*a* can comprise any of various sizes and shapes. To this extent, FIGS. 6, 7, 9 and 18 show an alternative small mini-table top 150*b*, FIG. 29 shows an alternative square mini-table top 150*d*, and FIG. 31 shows an alternative random shape mini-table top 150*e*. Further, it is understood that the table top's 150*a* composition could be of a variety of materials such as marble, wood, plastic, metal and so on. Returning to FIG. 2, whichever top 150*a* is chosen for use, the underlying purpose is the same. The alternate embodiment designs offer a way to close off the inner chamber, an area to store or place items such as a lamp, a book, a beverage, and the ability to mount the open roll holder 190 when open towel dispensing is required. The operation of the device 130 is the same with these embodiments as with the preferred embodiment shown in FIG. 14.

Figure 20:
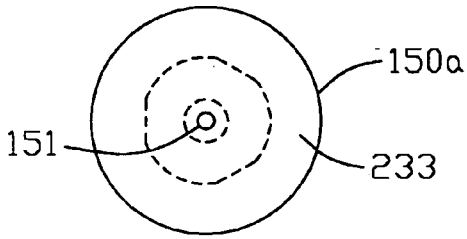
FIG. 20 is a top view, taken along line 20-20 of FIG. 19, showing the top of the mini-table top.
Figure 19:
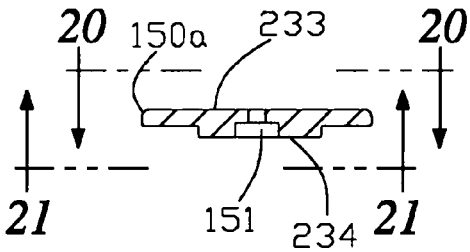
FIG. 19 shows a sectional view of the mini-table top only.
Figure 21:
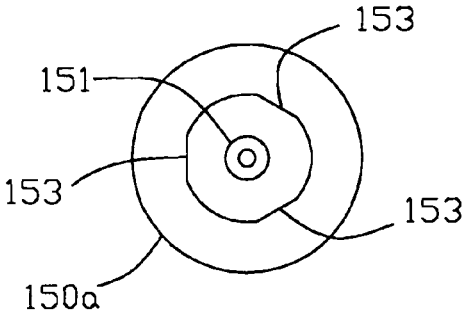
FIG. 21 is a bottom view, taken along line 21-21 of FIG. 19, showing the mini-table top locking flats on the bottom of the mini-table top that lock the metal hanging rods in place.
Figure 26:
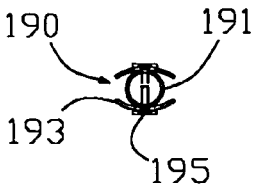
FIG. 26 is a top view, taken along line 26 of FIG. 25.
Figure 25:
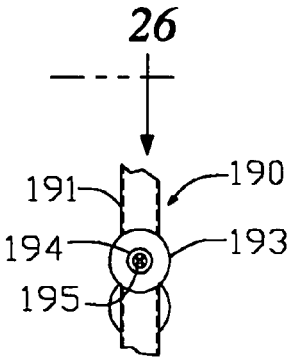
FIG. 25 is another elevation view, taken along line 25, of a portion of FIG. 24, showing mounting of the open roll holder brake and alignment disc.
Figure 24:
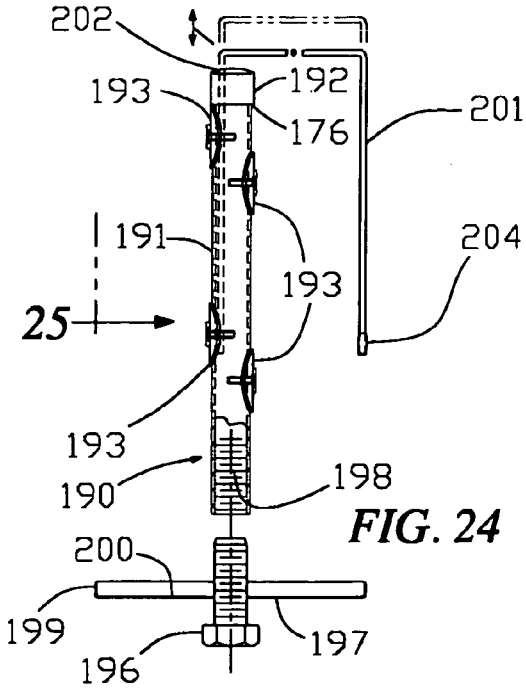
FIG. 24 is an elevation view of the open roll holder, which includes the open roll holder shield, the open roll holder arbor mounting screw, the open roll holder sheet unwind retainer rod, and loose items.

As shown in FIG. 2, the mini-table top 150*a* can be used to mount and support an open paper towel roll dispensing holder 190, while allowing for limited room around the perimeter for temporarily setting objects down. FIGS. 19-21 detail one embodiment, in which the mini-table top 150*a* has a counterbored hole 151 located in the center position of a top surface 233 and extends through a bottom surface 234, which is used to fasten the open roll holder assembly 190 (FIG. 2) in place. FIGS. 24-26 show one embodiment of the open roll holder assembly 190. As shown, open roll holder assembly 190 can be mounted to the mini-table top 150*a* (FIG. 2) using the open roll holder arbor mounting screw 196, made of metal or plastic. The roll holder 190 can be easily removed through one screw 196. When the open roll holder assembly 190 is not being used, the counterbored hole 151 (FIG. 21) can be filled using, for example, the mini-table top hole plug 152 shown in FIG. 4. In this case, the whole table top surface 233 (FIG. 19) can be utilized for papers, books, eye glasses, a cup of coffee, or similar items. When not in use, hole plug 152 can be stored in the inner storage container 210 (FIG. 2).

Returning to FIGS. 24-26, open roll holder assembly 190 can comprise (a) an open roll holder arbor 191 made from, for example, a ½ inch nominal size schedule A PVC pipe which has an internal threaded end 198 for mounting, (b) an open roll holder arbor rubber or plastic cap 192 which is fastened on the other end using, for example, lock adhesive 176, (c) four open roll holder brake and alignment discs 193 that can be made of rubber belting and similar type material, each of which can be fastened by an open roll holder decorative cup washer 194 and a mounting screw 195, (d) an open roll holder plastic shield 197 which has a base 200 and a outer lip 199, and (e) an open roll holder sheet unwind retainer rod 201 of plastic and alternatively of metal, with a retainer rod safety cap 204 of rubber or plastic. This retainer rod 201 slips into the open roll holder arbor cap offset hole 202.

Returning to FIGS. 1 and 2, the housing 140*a* can be supported by three wood side legs 154*a*. Each leg 154*a* can be mounted using a housing leg screw 155 and capped off with a side leg decorative hole plug 157. In one embodiment, there are two sets of housing leg screw mounting holes 146, which provide a choice of two different over-all device heights.

The dispensing stand 130 can employ two ways of easily moving or relocating the unit, lifting knobs 149 and caster assemblies 185. As shown in FIGS. 1 and 3, mounted on the outside of the housing 140*a* are two lifting and storage knobs 149, each of which can be fastened by a mounting screw 169. These knobs 149 provide a robust means to transport or move the device 130, as well as a place to hang other storage items. For example, to lift and transport the device 130, grabbing onto the robust knobs 149 is required. Further, these knobs 149 can also be utilized for hanging a service brush, a small writing pad and pencil, or other similar items.

Returning to FIG. 2, a caster leg assembly 185 is shown mounted on the bottom of each side leg 154*a* using a lock cup washer 162 and a mounting screw 189. In one embodiment, the screw 189 goes into a leg thread insert 159 which is a part of and located at the bottom of each leg 154*a*. The caster assembly 185 can comprise a caster leg 186, a caster mounting sleeve 188, which goes into the caster mounting hole 158, and a rug or hard floor caster 187. This caster assembly 185 provides a means to address more mobile applications while still maintaining device 130 stability. To this extent, the caster leg assembly 185 facilitates movement of the device 130 on carpet or a hard floor when device 130 moving flexibility is necessary, such as in a hospital setting where the floors must be cleaned daily.

Figure 7:
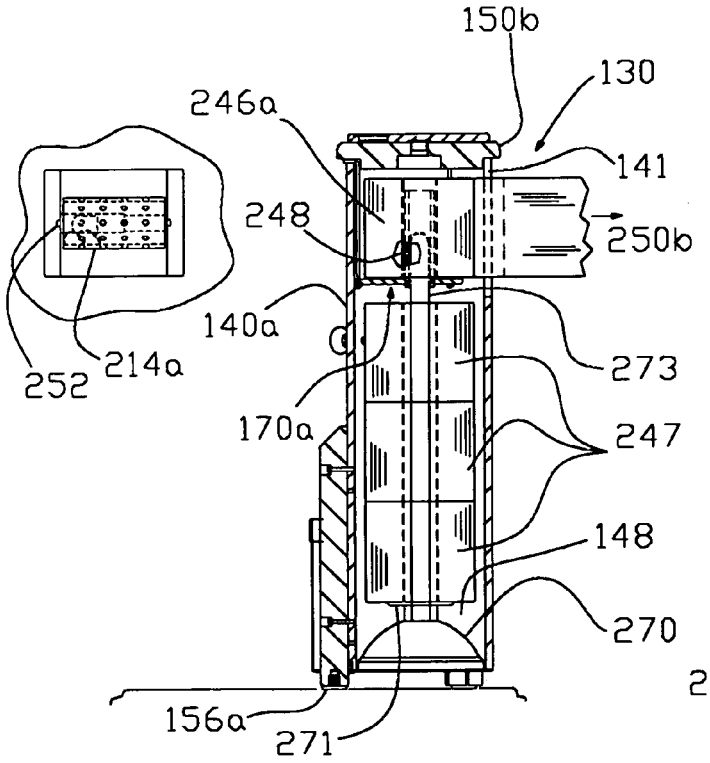
FIG. 7 shows a sectional elevation view taken along line 7-7 of FIG. 6, showing more detail, further shown is the conventional wall toilet paper dispenser with the perfume tube deodorizer assembly.

The device 130 is very stable with or without the caster assembly 185 based on the configurations and dimensions of the components chosen. The detailed drawings clearly show these relationships to those skilled in the relevant art. When the casters 185 are not required, each caster assembly 185 can be easily removed by detaching one locking cup washer 162 and one screw 189. Further, as shown in FIG. 7, for example, when the assemblies 185 (FIG. 2) are not being used, three leg adhesive floor pads 156*a* can be utilized, resulting in a more stable device 130 which also consumes less floor space.

Figure 10:
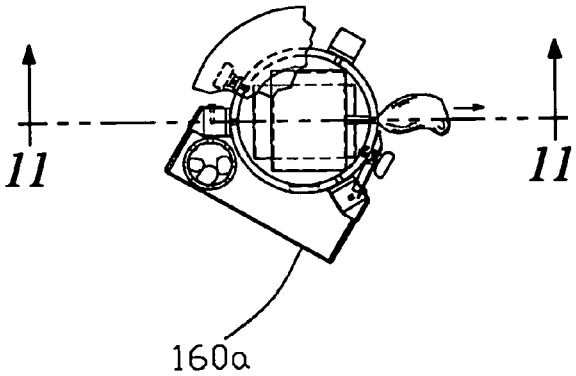
FIG. 10 shows a top view of a box of an active box of facial tissue sheets being dispensed from the upper position and one spare box of facial tissues sheets in the lower storage position, both resting on top of the inner storage container, also the open roll holder, the plurality of enclosed roll holders, and the caster leg assemblies, are not used in this dispensing arrangement.
Figure 16:
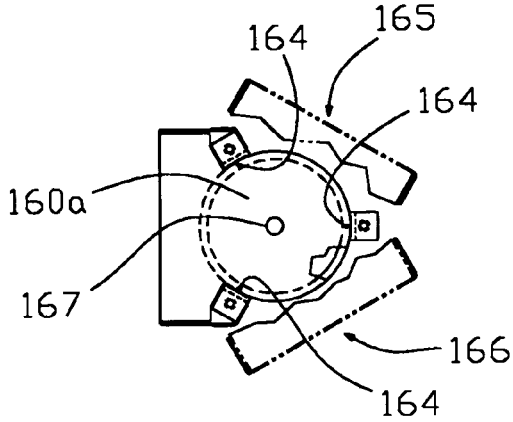
FIG. 16 is a bottom view, taken along line 16-16 of FIG. 14, showing how the outer storage half-basket is bottom mounted, how the basket closes-off the housing bottom, and how it can be rotated into two additional positions relative to the housing slot, storage half-basket #2 mounting position and storage half-basket #3 mounting position.

Returning to FIG. 2, the bottom surface of housing 140*a* can be enclosed using the plastic outer storage half-basket 160*a*. FIGS. 10 and 16 show one embodiment in which the storage half-basket 160*a* can be mounted by three mounting screws 164 (FIG. 16), which fit into the set of housing bottom screw mounting holes 145 (FIG. 2). Further, as shown in FIG. 1, storage half-basket 160*a* can also mount through the use of two outer plastic clips 161*a*, which are fastened to the basket 160*a* with plastic adhesive or cement and fastened to the side legs 154*a* using two screws 163. Returning to FIG. 16, if desired, the basket 160*a* can be mounted in the storage half-basket #2 mounting position 165, or the storage half-basket #3 mounting position 166, in relation to the housing 140*a* dispensing housing open slot 141 (FIG. 2). It is noted that on the bottom of the half-basket 160*a* is a vapor vent hole 167 which helps keep the inside of the housing chamber 148 (FIG. 2) dry. As shown in FIG. 2, a plurality of other storage items can be placed in storage half-basket 160*a* on the outside lower section of the device 130. For example, half basket 160*a* can hold a can of deodorizer, a perfume tube assembly 214*a*, a few personal papers, a book, magazines, an eye glass case, and other storage items. Ideally, this storage should be as small as possible, but still provide a useful convenience for the user.

Different materials can be successfully employed such as metals, or plastics to construct outer storage basket 160*a*. Further, as noted previously, housings for the device 130 can take on many forms, such as the alternative square housing 140*b* shown in FIG. 29. FIG. 29 also shows an alternative square housing half basket 160*b* for use with the alternative square housing 140*b*. In this case, half basket 160*b* can be attached using an alternative square roll holder assembly 170*b*, an alternative roll holder square housing stop 229*a*, which fastens with an alternative stop mounting screw 225, an alternative square housing half-basket 160*b*, and/or an alternative basket mounting z clip 161*b*.

Figure 17:
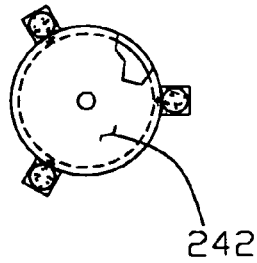
FIG. 17 is a bottom view which shows the alternate bottom closure plate embodiment, used when the outer storage half-basket is not used, also noted is that the caster leg assemblies are not used, being replaced by the leg adhesive floor pads.
Figure 33:
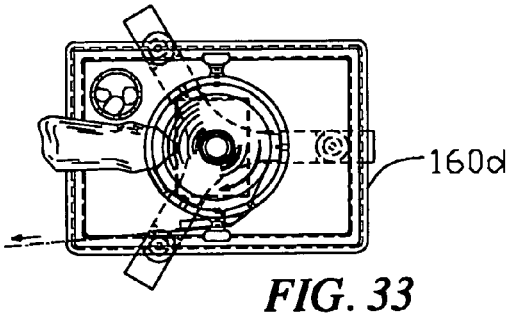
FIG. 33 is a top view, taken along line 33-33 of FIG. 32.
Figure 36:
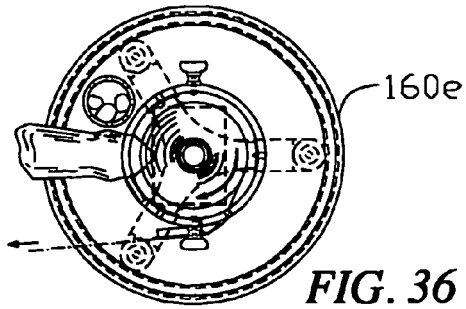
FIG. 36 is a top view, taken along line 36-36 of FIG. 35.
Figure 32:
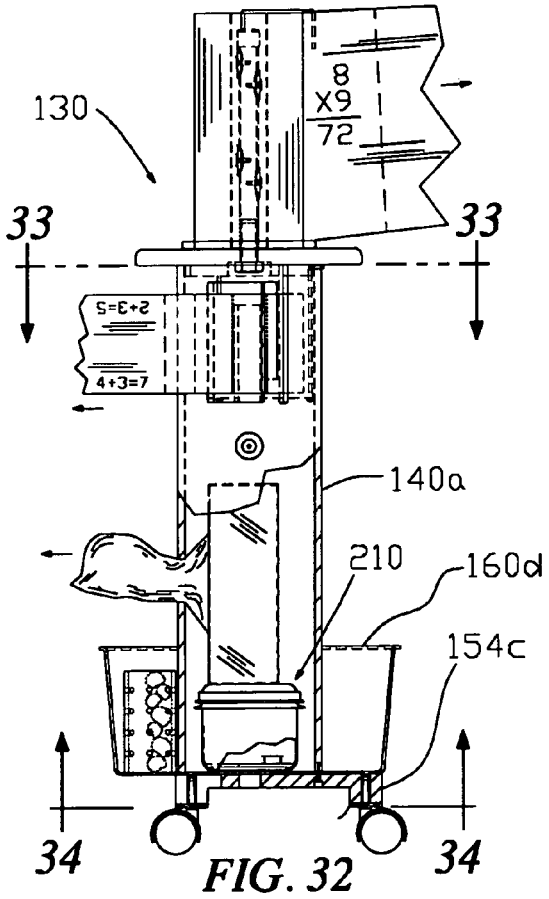
FIG. 32 is an elevation view showing simultaneous dispensing of an educational and commercial ad towel roll, an educational and commercial toilet roll, and an active box of facial tissue sheets, also the alternate outer storage rectangular full basket, and alternate bottom spider leg are shown.
Figure 35:
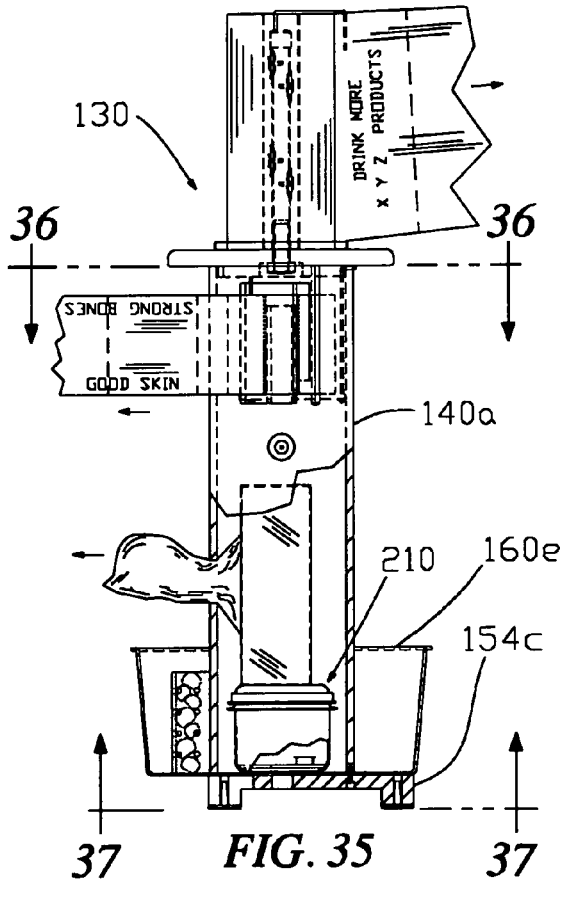
FIG. 35 is an elevation view showing the simultaneous dispensing of a towel roll, a toilet roll and facial sheets, with the alternate outer storage round full basket, alternate bottom spider leg, and educational and commercial ad toilet roll and educational and commercial ad towel roll embodiments, also noted is that the casters are not used in this arrangement.
Figure 34:
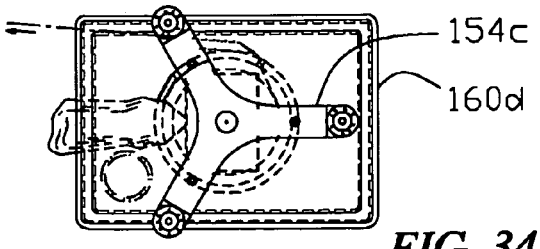
FIG. 34 is a bottom view, taken along line 34-34 of FIG. 32, which does not show the casters.
Figure 37:
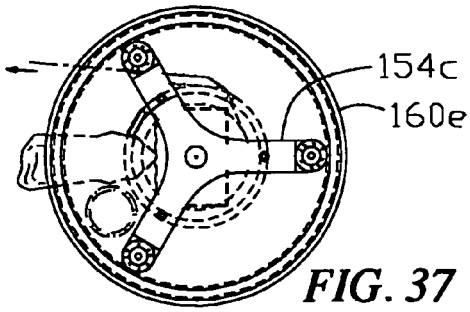
FIG. 37 is a bottom view, taken along line 37-37 of FIG. 35.

Further, device 130 could comprise the alternative triangular housing 140*c* shown in FIG. 31. In this case, FIG. 31 shows an alternative triangular housing half basket 160*c* that can attach to triangular housing 140*c* using an alternative triangular roll holder assembly 170*c*, an alternative roll holder triangular housing stop 229*b*, an alternative triangular housing half-basket 160*c*, and/or an alternative basket mounting clip 161*c*. Still further, FIGS. 32-34 show an alternative outer storage rectangular full basket 160*d*, and FIGS. 35-37 show an alternative outer storage round full basket 160*e*. It is understood, however, that one or more embodiments of device 130 can be constructed without outside storage basket 160*a*. For example, FIG. 17 shows the basket removed and replaced with an alternative bottom closure plate 242. The operation will incur only obvious changes that is, limits to outer storage ability. The device's 130 claims or operation will not be affected by these embodiments.

Figure 30:
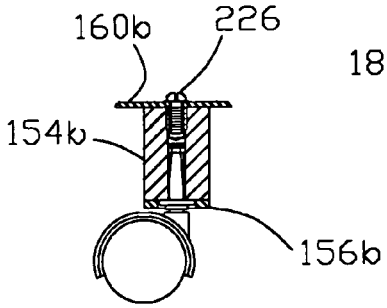
FIG. 30 is a partial sectional view, taken along line 30 of FIG. 29 and FIG. 31, showing the alternate button leg.

It is understood that side legs 154*a* (FIG. 1) can comprise any of various sizes and shapes. For example, FIGS. 29 and 30 show the use of an alternative button leg 154*b*, which mounts directly to the bottom of an alternative square housing half-basket 160*b* or to the bottom of an alternative triangular housing half basket 160*c* shown in FIG. 31. Button leg 154*b* can be fastened using an alternative button leg screw 226. Additionally, FIGS. 32-37 show the use of an alternative bottom spider leg 154*c*, which also mounts through the bottom of alternative full-baskets 160*d* and 160*e* and/or to the housing 140*a*, respectively. It is understood that a variety of different possible materials or manufacturing processes could be used to produce these parts. In any event, the legs 154*a* provide stability and a means to adjust the height of the device 130 and can successfully take on many forms without changing the operating characteristics of the invention. To this extent, bottom spider leg 154*c* and the alternate outer baskets 160*d* or 160*e* molded as one piece of plastic. Similarly, the outer storage half-basket 160*a* and the outer storage half-basket clip 161*a* can be molded out of one piece of plastic. Finally, as shown in FIG. 30, when the assemblies 185 (FIG. 2) are not being used, alternative button leg 154*b* can use an alternative leg adhesive floor pad 156*b*.

Figure 14:
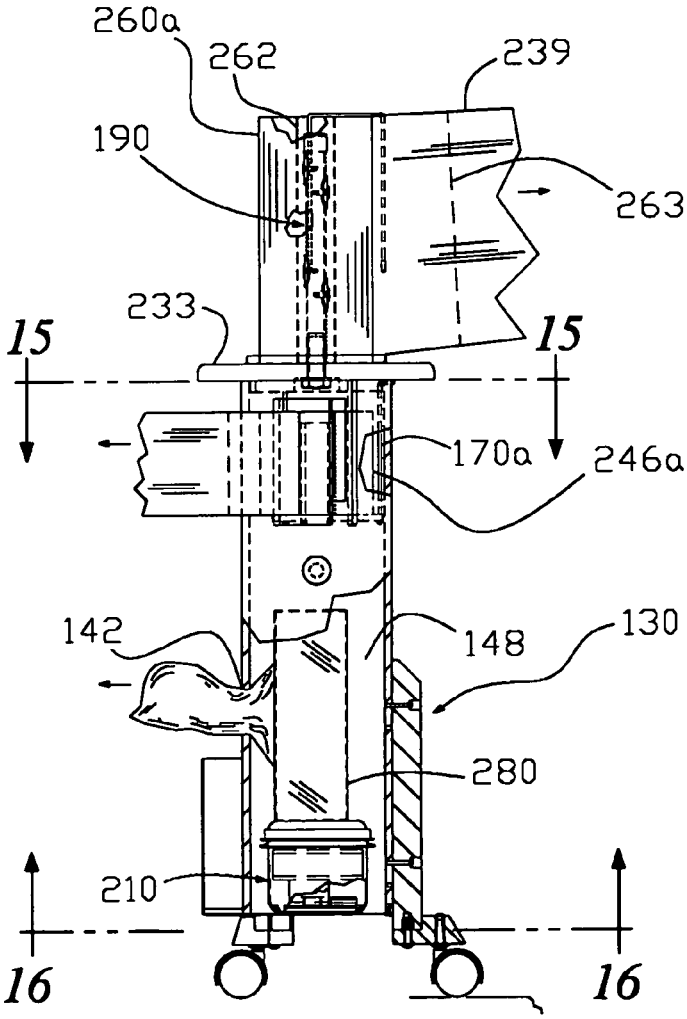
FIG. 14 is an elevation view, showing the simultaneous dispensing of an active paper towel roll, an active toilet paper roll and an active box of facial tissue sheets, also it shows the ability at the same time to store items in the inner storage container, in the outer storage half-basket and on edge of the mini-table top, also noted, is the use of caster leg assemblies.

The main advantage of the stand device 130 is its multiple dispensing capabilities. In fact, the device 130 as a whole, can dispense a broad range of roll sizes and types of similar products in a plurality of unprinted and/or printed form products. For a specific detailed description, the operation of each dispensing option is explained individually throughout the patent specification, and by referring to FIG. 14. FIG. 14 shows a sectional elevation view of the stand 130 while simultaneously dispensing three paper products of a plurality of paper types. In particular, the device 130 is so conceived and equipped to simultaneously dispense all three kinds of popular paper products, e.g., toilet rolls 246*a*, towel rolls 260*a* and pop-up facial tissue box sheets 280. This dispensing arrangement provides the essence of the invention, the multiple type paper dispensing mobile stand with mini-table and storage ability.

To dispense the paper towel roll 260*a* from the device 130, the open dispenser 190 can be used. The open dispenser 190 is shown mounted on the mini-table top surface 233. Standard dimensions of an active paper towel roll 260*a* are 4¾ inch nominal diameter×11 inch nominal height×11 inch nominal perforation spacing×1⅝ inch nominal core diameter. In one embodiment shown in FIG. 9, when otherwise empty, the inner chamber 148 can be used to store up to two spare rolls of paper towels 261 while an active paper towel roll 260*a* can be dispensed using the open roll holder 190. In this case, in order to access any spare towel rolls 261 within the chamber 148, the mini-table top 150*b* can be lifted straight up, and returned back in a similar manner.

Referring to FIGS. 24-26 together with FIG. 14, in operation, a roll of paper towels 260*a* may be placed onto the arbor 191, in the direction preferred, and then the retainer rod 201 can be replaced into the cap's 192 offset hole 202. The shield base 200 protects the table top surface 233 and also provides a low friction surface during product use. If the device 130 is near an air fan, or if a person passes quickly by the device 130, the roll web 239, while in a vertical position, has a tendency to unwind. To prevent this, the open roll holder sheet unwind retainer rod 201 in combination with the shield lip 199 keeps the roll web 239 from unwinding until the next usage. When replenishing the open roll holder 190 with a paper product, a user can lift off the unwind retainer rod 201.

The open web path for paper towel roll web 239 exposes the towel tear perforations 263 and when a swift downward jerk is made on the web 239, the paper towel roll center core 262 flexes and compresses the open roll holder brake and alignment discs 193, which locks the roll 260*a* and prevents turning, resulting in the web 239 tearing off. In particular, the open roll holder brake and alignment discs 193 provide a means to fill the paper towel roll center core 262, even if distorted, and provide a flexing action when the towel roll 260*a* web 239 is pulled. The flex magnitude is controlled by the speed of the web 239 being pulled. That flexing action of the discs 193 produces a braking or locking of the roll 260*a* when a fast downward pull is made, resulting in the web 239 tearing along the paper towel roll web tear perforations 263.

Figure 15:
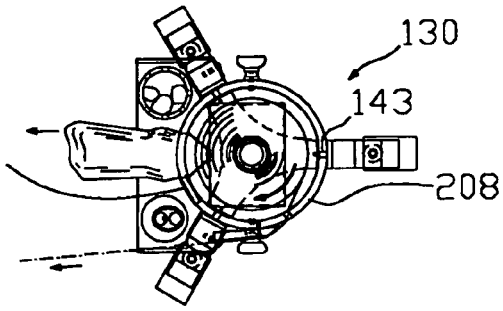
FIG. 15 is a top view, taken along line 15-15 of FIG. 14 showing more detail.
Figure 23:
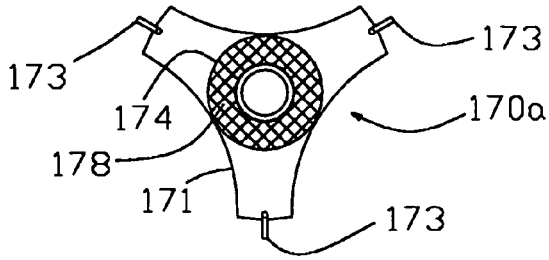
FIG. 23 is a top view, taken along line 23-23 of FIG. 22, showing the hanging roll holder spider base, the metal hanging rods, and the loose roll holder brake washer with it's brake washer friction surface in more detail.
Figure 22:
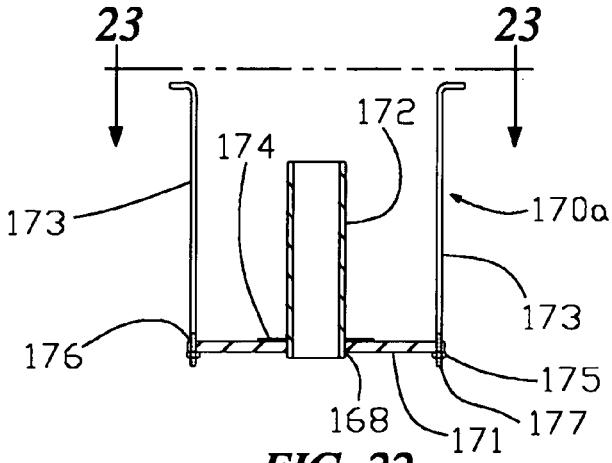
FIG. 22 shows the hanging roll holder assembly in sectional elevation view, the roll holder brake washer is shown as a loose item and can be flipped over for dual friction surface selection.

As shown in FIG. 14, device 130 can dispense products contained within chamber 148. For example, to dispense standard paper toilet rolls 246*a* from the device 130 enclosed or concealed, FIG. 7 shows a housing open slot 141 at the top end of the housing 140*a* tube which provides the opening for the web path for hand tear-off of toilet roll sheets 250*b*, or the web path for tear-off using the tear plate on toilet roll sheets. Further, FIGS. 7, 8, 14, 39, and 40 demonstrate the use of the hanging roll holder 170*a*. In particular, as shown in FIG. 15, on the housing top surface 208 are three housing rod grooves 143, which support the hanging roll holder assembly 170*a* (FIG. 14). Assembly 170*a* can be configured to hold an active toilet paper roll 246*a* having standard dimensions of 4¾ inch nominal diameter × 4½ inch nominal height × 4 inch nominal perforation spacing × 1⅝ inch nominal core diameter. To this extent, as shown in FIGS. 22-23, assembly 170*a* can comprise a hanging roll holder spider base 171, a hanging roll holder hollow arbor 172 which is centered on the base 171 and can be made from, for example, a 1 inch schedule 40 PVC pipe fastened using plastic adhesive 168, three metal hanging rods 173 of ⅛ inch diameter brass and alternate material fastened using a roll holder rod threaded end 177 with a hanging roll holder lock-nut 175 and/or a lock adhesive 176, and a roll holder brake washer 174 which is inserted as a loose item over the arbor 172 and made from a type of rubber belting material. This washer 174 has brake washer friction surface 178 of a high friction side and on the other a low friction side and can be assembled onto the holder arbor 172 in the desired direction to suit the web tension requirements. Additionally, as shown in FIG. 21, mini-table top 150*a* can include three mini-table top locking flats 153 to retain the hanging roll holder rods 173 in place.

As shown in FIG. 7, for example, and discussed in conjunction with FIGS. 22-23, assembly 170*a* can hold the active toilet paper roll 246*a*, which can be relatively hard or very soft, with its customary toilet roll center core 248. Depending on the roll directional placement onto the arbor 172 and onto the brake washer friction surface 178 selected, it produces either the web path for low web tension of toilet roll 246*a*, or the web path for high web tension of toilet roll 246*a*. These web paths produce a different breaking angle against the device 130 housing slot 141, resulting in different web 250*b* tensions.

In order to pull the web 250*b* with quasi uniform high web tension, the rougher side of brake washer friction surface 178 can be disposed facing up. Next, a toilet roll 246*a* may be dropped onto the hanging roll holder hollow arbor 172, the roll tail is fed through the housing open slot 141, making sure the direction the roll is dropped is for the high breaking angle web path. The mini-table top 150*b* can then be replaced by placing it on the housing top surface 208 (FIG. 15). When using the hanging holder 170*a*, mini-table top 150*b* may be rotated until the locking flats 153 (FIG. 21) engage the roll holder hanging rods 173.

Returning to FIG. 14, device 130 can be further configured to dispense facial tissue sheets 280. To this extent, housing 140*a* is shown including a housing feel and feed hole 142, which is also shown in more detail in FIG. 3. In one embodiment, housing feel and feed hole 142 is positioned near the bottom end of the housing 140*a*. Housing feel and feed hole 142 can be configured to accommodate an active box of facial tissue sheets 280 being a standard pop-up box is 3¼ inch nominal high×4⅝ inch nominal wide×9½ inch nominal long. A new active box 280 may be inserted with a tissue exposed by dropping it into the housing 140*a*, oriented with the exposed tissue in the direction of the feed hole 142, and then externally, reaching through with your fingers and pulling out the first tissue. The tissues now remain exposed throughout usage.

Figure 11:
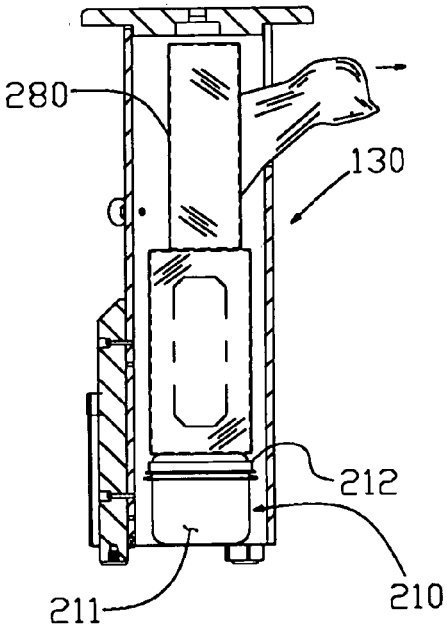
FIG. 11 shows a sectional elevation view, taken along line 11-11 of FIG. 10 providing additional detail.

Another advantage of the stand device 130 is its multiple storage capabilities. Returning to FIG. 2, a storage container 210 is shown disposed inside housing chamber 148. As indicated in FIG. 11, container 210 comprises a body 211, and a cover 212. As shown in FIG. 2, storage container 210 can reside, in most dispensing arrangements or modes of operation, inside the housing 140*a* at the bottom of the inner chamber 148, and provide storage for other items. For example, as shown in FIG. 14, the container 210 can act as the mandrel or support for the active facial tissue box 280 having limited movement within the housing 140*a* inside diameter and dispensed through the feed hole 142. Other examples of the various arrangements that are possible are shown in FIGS. 2, 8, 11-13, 32, 35, 38-40, 45-46, and 48 make reference to this container 210. Alternatively, in some device 130 configurations, for example FIGS. 7, 9 and 47, the container 210 is not used in the device 130. To this extent, the container 210 can comprise a material suited for microwave cooking use. As a result, the container 210 can be utilized in the kitchen as a food container, suitable for microwave cooking. This cooking feature, although not required for the operation of the device 130, does confirm and reinforce the greatest utilization of parts philosophy of the patent.

Device 130 can also be used to store other non-paper products. For example, FIG. 7 shows another device 130 arrangement that removes the inner storage container 210 (FIG. 2) from the device 130 and stores a basin plunger 270 in the housing inner chamber 148. Further, a basin plunger plastic sanitary shield 271 can be removed from the storage container 210 and slipped over the handle 273 of the plunger 270. Sanitary shield 271 can prevent items placed on top of it from contacting plunger 270. For example, three spare toilet paper rolls 247 can be slipped over the handle 273. Further, the hanging roll holder hollow arbor 172 (FIG. 22), can be placed in position by slipping or nesting over the basin plunger handle 273.

Figure 8:
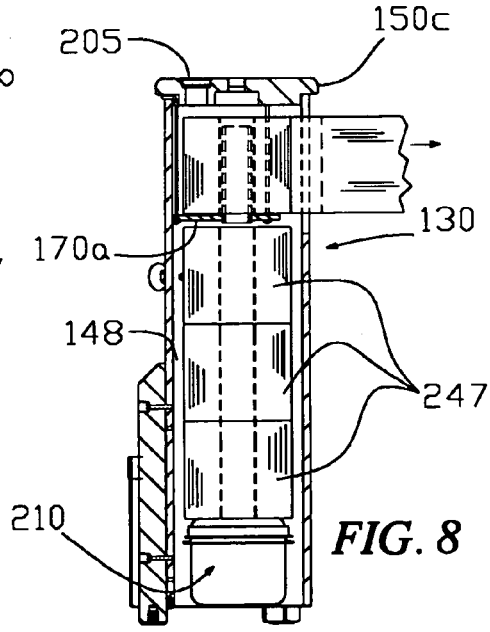
FIG. 8 shows a sectional elevation view, showing an active toilet paper roll being dispensed and three spare toilet paper rolls and the inner storage container in use, also without the open roll holder and the caster leg assemblies, and with the alternate time clock mini-table top embodiment.

Further, inner chamber 148 can provide storage in various dispensing and/or storage arrangements that are possible using device 130. To this extent, alternative arrangements can be used to store and/or dispense a single type of product. In any event, housing feel and feed hole 142 (FIG. 2) can provide the means to feel for the presence of storage rolls within inner chamber 148. For example, in arrangements shown in FIGS. 7, 8, and 48, device 130 can dispense only toilet paper 246*a*. As discussed above, FIG. 7 shows a plunger 270 stored in conjunction with spare toilet paper rolls 247. Alternatively, as shown in FIGS. 8 and 48, the container 210 can be located at the bottom of the housing inner chamber 148, and have up to three spare toilet paper rolls 247 stored on top of it.

Figure 42:
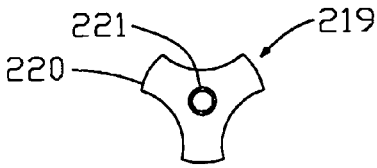
FIG. 42 is a top view taken along line 42-42 of FIG. 41, showing the enclosed lower roll holder spider base in more detail.
Figure 44:
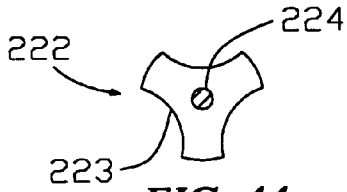
FIG. 44 is a top view taken along line 44-44 of FIG. 43, showing the enclosed upper roll holder spider base in more detail.
Figure 41:
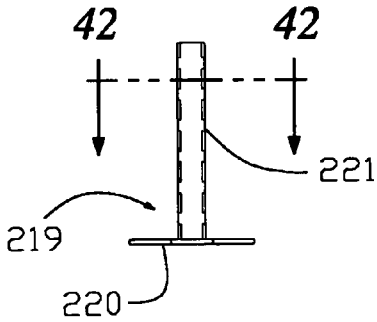
FIG. 41 is an elevation view showing the enclosed lower roll holder assembly.
Figure 43:
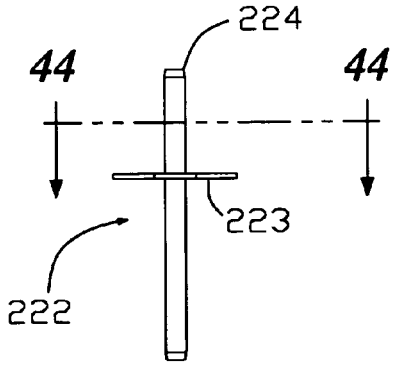
FIG. 43 is an elevation view showing the enclosed upper roll holder assembly.
Figure 50:
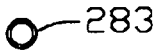
FIG. 50 is a top view taken along line 50-50 of FIG. 49.
Figure 49:
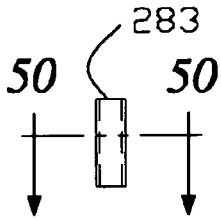
FIG. 49 is an elevation view showing the long tube spacer.
Figure 52:
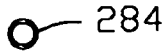
FIG. 52 is a top view taken along line 52-52 of FIG. 51.
Figure 51:
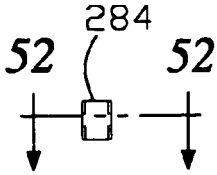
FIG. 51 is an elevation view showing the short tube spacer.

Returning to FIG. 2, device 130 can further include various other parts that can assist in one or more storage/dispensing arrangements. To this extent, device 130 is shown including a lower holder 219 and an upper holder 222. As detailed in FIGS. 41 and 42, lower holder 219 can comprise a spider base 220, which aids in holder 219 insertion, and a hollow arbor 221 of, for example, one inch schedule 40 PVC pipe that can be centered and cemented to the base 220. As detailed in FIGS. 43 and 44, upper holder 222 can comprise a spider base 223 and a solid dual arbor 224 with tapered ends for ease of installation, and comprising PVC, for example, that can be centered and cemented to spider base 223. Upper holder 222 is designed to nest or slide easily within the arbor 221 (FIG. 41) of assembly 219 (FIG. 41) and may be inserted both ways, depending on the dispensing arrangement required. Still further, device 130 (FIG. 2) can include two spacers stored in, for example, container 210. FIG. 49 shows a long tube spacer 283, while FIG. 51 shows a short tube spacer 284. FIG. 50, shows a top view of long tube spacer 283 and FIG. 52 shows a top view of short tube spacer 284. Each spacer 283, 284 is configured to slip onto the arbor 224 (FIG. 43) of holder 222 (FIG. 43) to maintain the holder base 223 (FIG. 42) in a desired dispensing position.

Figure 40:
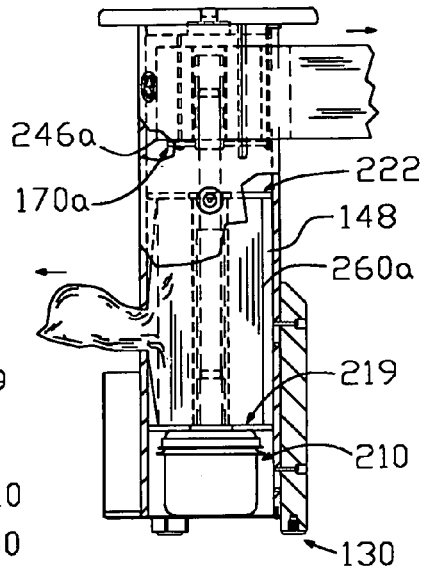
FIG. 40 is an elevation view showing the enclosed dispensing of a paper towel roll using holder and a toilet roll using the hanging roll holder, also without the open roll holder assembly, the caster assemblies and the web tear plate assembly.
Figure 46:
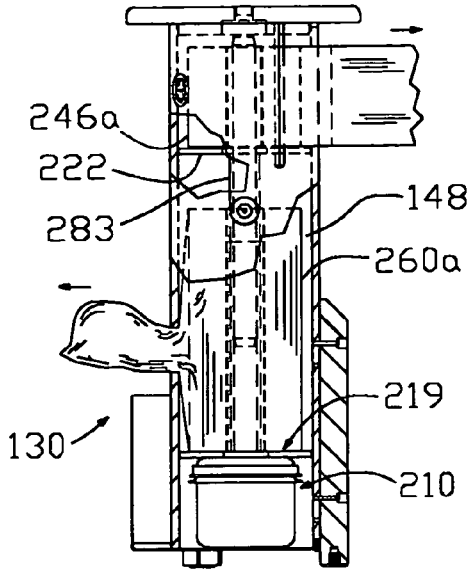
FIG. 46 is an elevation view showing the dispensing of a paper towel roll using enclosed lower roll holder and a toilet roll using the enclosed upper roll holder and the long tube spacer; also, without the open roll holder assembly, the caster leg assemblies and the web tear plate assembly.
Figure 47:
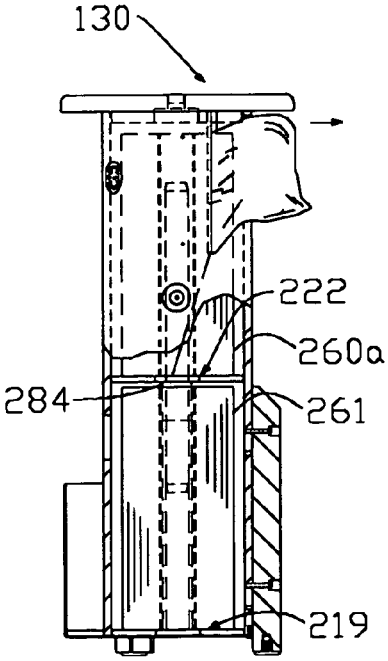
FIG. 47 is an elevation view showing the storage of a paper towel roll using enclosed lower roll holder and the dispensing of a towel roll using enclosed upper roll holder and the short tube spacer, also without the open roll holder assembly, the caster leg assemblies and the web tear plate assembly.
Figure 48:
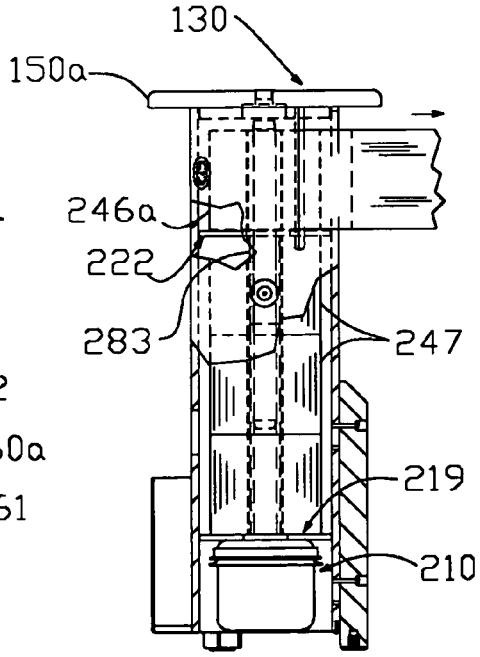
FIG. 48 is an elevation view showing the dispensing of a paper toilet roll using enclosed upper roll holder and the long tube spacer, and three toilet rolls in storage using the enclosed lower roll holder; also, without the open roll holder assembly, the caster leg assemblies, and the web tear plate assembly.

Use of the holders 219 and 222 is illustrated by the several dispensing arrangements shown in FIGS. 40 and 46-48. For example, as shown in FIGS. 40 and 46, device 130 can be configured to dispense toilet paper 246*a* as well as enclosed or concealed standard paper towel roll 260*a* being inside the chamber 148 using the lower inner dispenser holder 219. In FIG. 40, hanging roll holder 170*a* is used to hold toilet paper 246*a* while the end of holder 222 nests within the arbor 172 (FIG. 22) of holder 170*a*. Alternatively, FIG. 46 shows a configuration in which toilet roll 246*a* can be dispensed using the upper roll holder 222 supported by the lower roll holder 219 and the long spacer 283, all located on top of the storage container 210. As shown in FIG. 48, this dispensing arrangement also accommodates up to three additional spare rolls 247. In this case, when the toilet roll 246*a* runs out, the mini-table top 150*a* is lifted straight up and off the device 130, and the remaining toilet roll core is lifted straight up and discarded. In still another alternative, FIG. 47 shows a configuration in which the upper inner dispenser holder 222 is supported by the lower roll holder 219 and the short tube spacer 284 to dispense paper towel roll 260*a*, while a spare roll 261 is held in a storage position within the lower holder 219.

Figure 12:
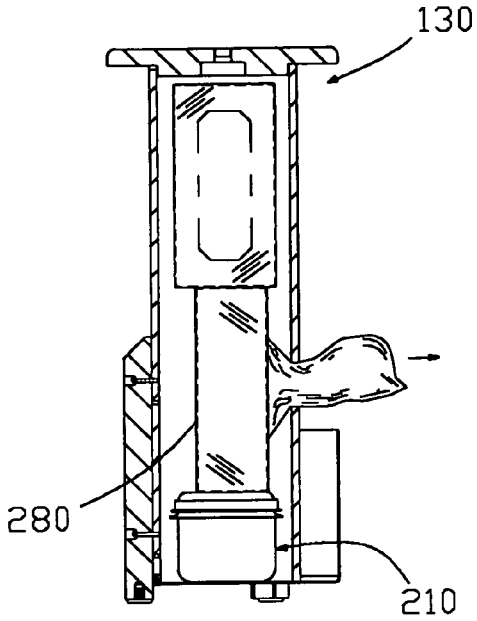
FIG. 12 shows a sectional elevation view of an active box of facial tissue sheets being dispensed from the lower position on top of the inner storage container, and one spare box of facial tissue sheets in the upper storage position, also without the open roll holder, the plurality of enclosed roll holders, and without the caster leg assemblies.
Figure 13:
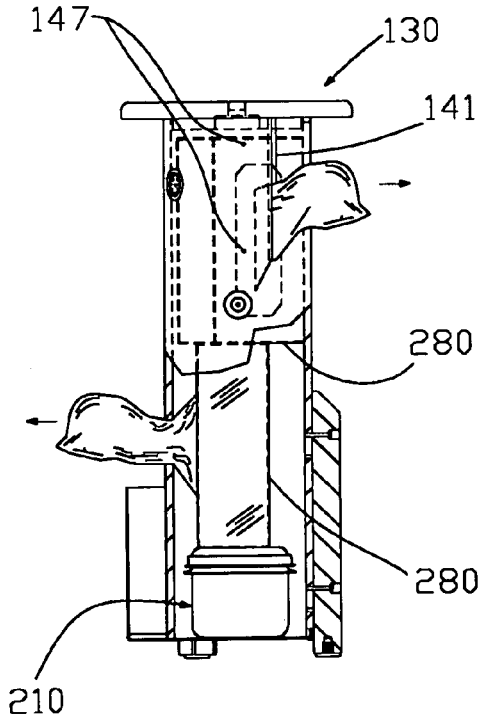
FIG. 13 shows an elevation view showing a dual dispensing arrangement of the same type of paper product, an active box of facial tissue sheets being dispensed from the upper and lower positions, on top of the inner storage container, also without the open roll holder, the plurality of enclosed roll holders, the caster leg assemblies, and without the web tear plate assembly.

However, it is understood that various dispensing arrangements for device 130 may not use holders 170*a*, 219, 222 and/or spacers 283, 284. For example, as shown in FIG. 14, holders 219 and 222 may not be used in the device 130 if a facial tissue box 280 is required to be dispensed in the lower chamber. Further, FIGS. 11-13 illustrate the upper dispensing, lower dispensing, and dual dispensing, respectively, of paper facial tissue sheets 280 of a pop-up box type in which the various holders and spacers are not used. For these and other dispensing arrangements, the various holders may be stored in a location away from the device 130. In any event, for the upper dispensing of paper facial tissue sheets 280 as shown in FIGS. 11 and 13, the tissue can be aligned with and slipped into the open slot 141 as paper facial tissue sheets 280 are inserted. Further, FIGS. 11 and 12 show arrangements that include storage of a spare box 281. To this extent once tissues are depleted from the top box 280 in FIG. 11, it may be exchanged with the bottom spare box of facial tissue sheets 281, until stock is replenished.

Figure 5:
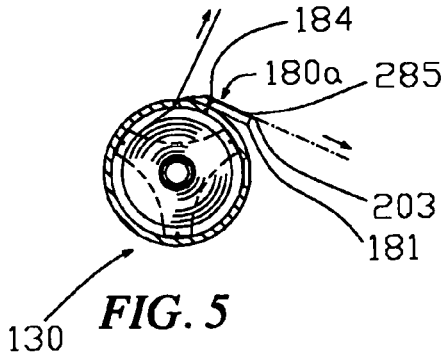
FIG. 5 shows a top view, taken along line 5-5 of FIG. 4, of the housing tube inner storage and dispensing chamber, showing web dispensing of an active toilet paper roll using the web path for low web tension of toilet roll, and a web path for tear-off using tear plate on toilet roll sheets or the web path for hand tear-off of toilet roll sheets if preferred.
Figure 54:
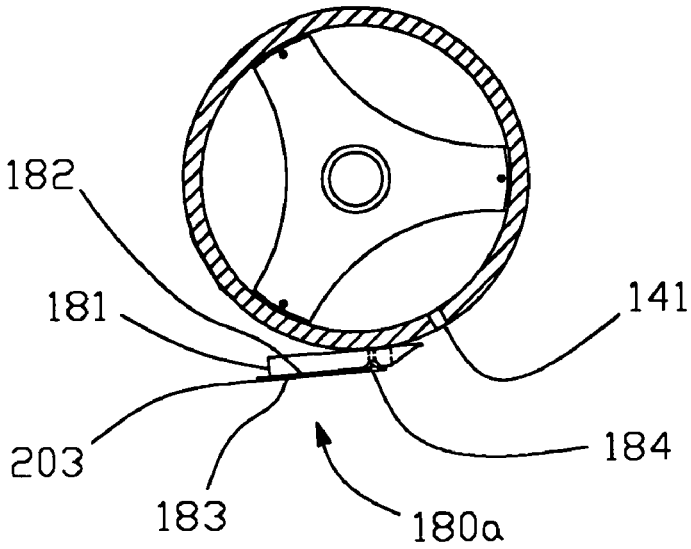
FIG. 54 is a top view taken along line 54-54 of FIG. 53.
Figure 53:
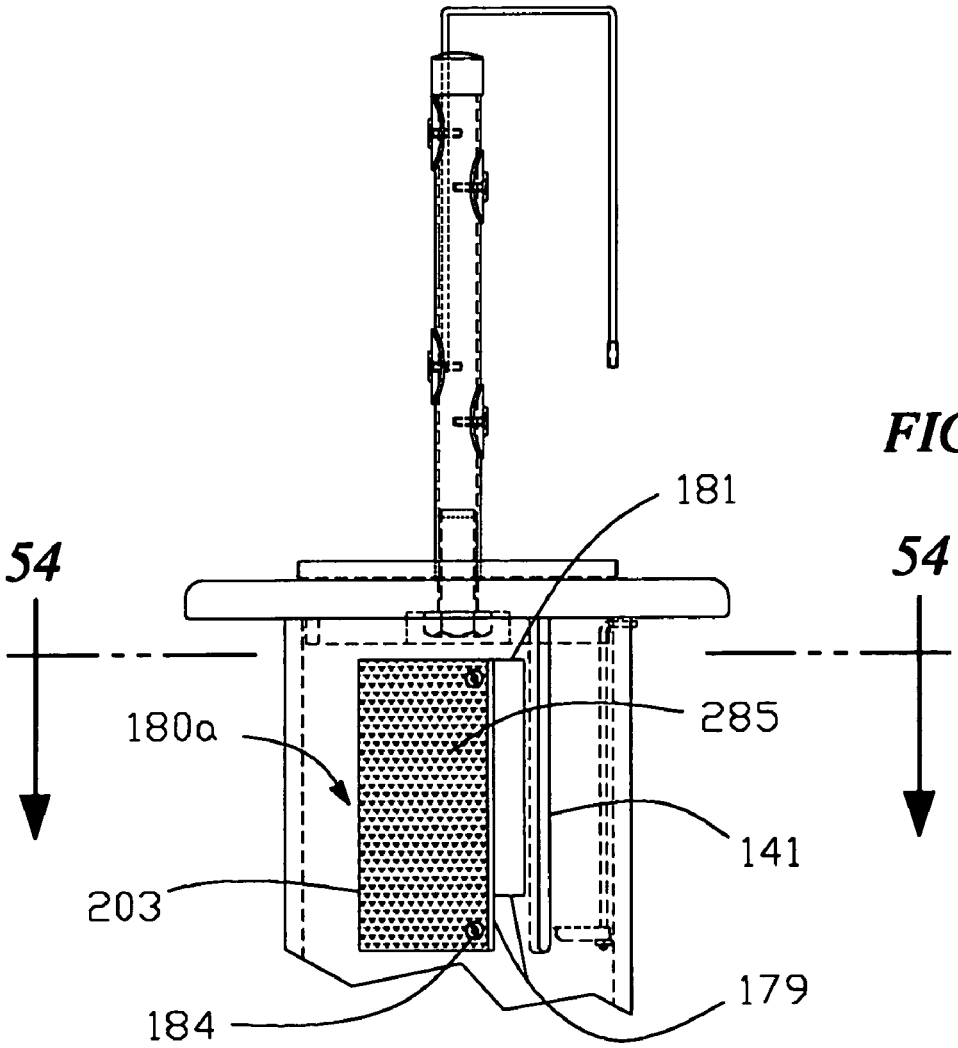
FIG. 53 is a partial elevation view showing the web tear plate in more detail.

As improvement, various other features are included in device 130. To this extent, as shown in FIGS. 5 and 53-54, device 130 can include a unique toilet paper web tear plate 180*a*. In this case, device 130 can include two housing tear plate screw mounting holes 147 (FIG. 2) near the open slot 141 for mounting the web tear plate assembly 180*a*. This assembly 180*a* can be mounted to device 130 using two mounting screws 184 and screw mounting holes 147. As a result, when not desired, tear plate assembly 180*a* can be removed by removing the web tear plate mounting screws 184. In any event, the tear plate assembly 180*a* can comprise a web tear plate base 181, and an abrasive surface 285 that assists in tearing and securing the paper product. In one embodiment, abrasive surface 285 comprises a cloth/resin substrate 182 that includes grit 183 on one side to form the web tear plate abrasive (e.g., sandpaper). Substrate 182 can be mounted to web tear plate base 181 such that a web tear plate abrasive tear edge 203 overhangs the base 181. It should be noted that the web tear plate pick-up notch 179 on the assembly 180*a* aids in grabbing the toilet roll 246*a* web for the next usage.

When the tear plate assembly 180*a* is being used, the web is pulled out from the device 130 via open slot 141, moved in contact with the abrasive surface 285 in a backward and downward motion against the tear edge 203, thus tearing-off the web. The web is torn against the abrasive tear edge 203, which has self-renewing properties common to the use of abrasives. Further, the tear plate assembly 180*a* has ability to hold the web with the abrasive surface 285. As a result, even though dispensed in a vertical position, the web is shown to be held securely against the abrasive surface 285 and ready for the next pull. In addition, when using the tear plate assembly 180*a*, the toilet roll 246*a* (FIG. 14) product does not need to have perforated tear sheets to produce a clean tear. Various alternative configurations for web tear plate assembly 180*a* are possible. For example, FIG. 29 shows an alternate web tear plate assembly 180*b* which is designed with a different abrasive tear edge contour and/or with a contoured mounting surface. In this case, alternative tear plate assembly 180*b* comprises a curved web tear plate base 181*b* and the web tear plate abrasive tear edge 203*b* of a different contour. This alternative embodiment would be used in the same manner, and would poses the same function abilities as the preferred embodiment shown in FIGS. 5 and 53-54.

Figure 6:
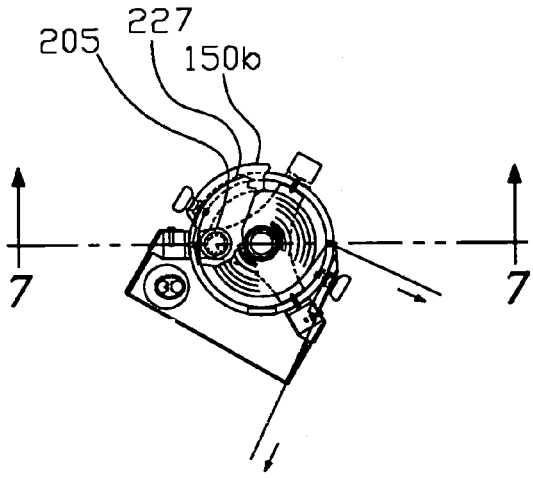
FIG. 6 shows a top view of an active toilet paper roll being dispensed using the web path for high web tension of toilet roll, and three spare toilet paper rolls and a basin plunger in storage, and without the use of the open roll holder, the enclosed lower roll holder and the enclosed upper roll holder, and the caster leg assemblies, also with the alternate small mini-table top and with the alternate time clock coaster, further shown is the web path using tear plate or if preferred, the web path for hand tear-off.
Figure 9:
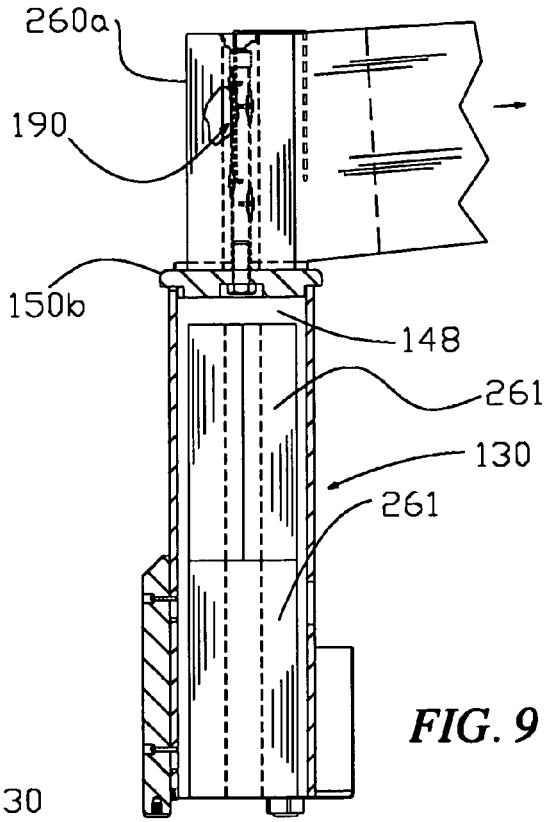
FIG. 9 shows a sectional elevation view showing an active paper towel roll being dispensed, two of spare roll of paper towels in storage, and without the plurality of enclosed roll holders, the web tear plate assembly, the caster leg assemblies; and with the alternate small mini-table top embodiment.
Figure 18:
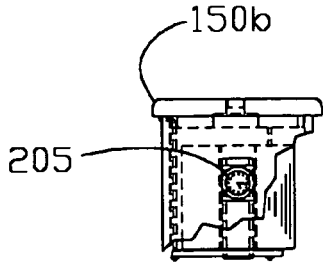
FIG. 18 is a partially cutaway elevation view of the upper end of the device showing the time clock embedded in the housing, also without the open roll holder, and with the alternate small mini-table top embodiment.

Returning to FIG. 2, device 130 can further be configured to include a time clock. In one embodiment, the time clock can be mounted on the outside housing side, near the tear plate 180*a* (FIG. 53). For example, as shown in FIG. 2, housing 140*a* can include a housing clock mounting hole 144 that allows for ready mounting of the time clock 205 as shown in FIG. 18. Further, clock 205 can be easily removed from the housing 140*a* to change the time or battery. It is understood that inclusion of the time clock function comprises only a convenience for the user and can be located in any of various locations on device 130. For example, FIG. 6 shows the time clock 205 embedded in a separate alternate table coaster 227. Further, FIG. 8 shows an alternative time clock mini-table top 150*c* in which the time clock 205 is embedded in the surface of the mini-table top 150*c*. The alternate time clock coaster 227 or the alternate time clock mini-table top 150*c* are just different methods to provide the conceptual time function convenience. The ability to view a time clock 205 somewhere on the device 130 is strictly a user preference and an outright convenience.

Figure 27:
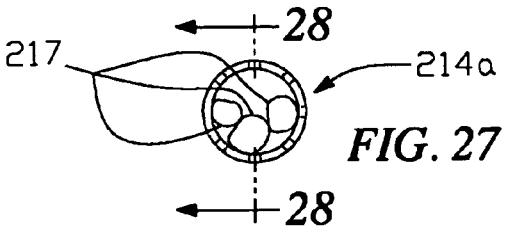
FIG. 27 is an enlarged end view of the perfume tube deodorizer assembly.

Returning to FIG. 2, device 130 can also be provided with a perfume tube assembly 214*a*. The perfume tube assembly 214*a* is used to give air freshening aroma to the surrounding area where the dispensing stand 130 is used, and can be stored in the outer storage half-basket 160*a*. In one embodiment shown in FIGS. 27 and 28, the perfume tube assembly 214*a* can comprise a tube body 215 made from, for example, a 2 inch nominal size schedule 40 PVC pipe. The tube body 215 can have a series of perfume tube air holes 216 on its surface which aid in dispersing the perfume aroma. Additionally, perfume tube cotton balls 217 can be placed inside the perfume tube body 215. The operation of the perfume tube assembly 214*a*, is self explanatory. Perfume can be sprayed or poured onto the cotton balls 217. For example, the cotton balls 217 can be dislodged from the tube body 215 and placed onto a paper towel sheet, on which they can be sprayed with perfume, and inserted back into the tube body 215.

Figure 28:
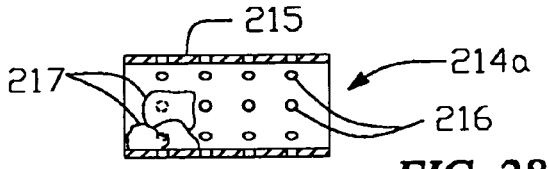
FIG. 28 is a sectional view, taken along line 28-28 of FIG. 27.

Alternatively, as shown in FIG. 7, the assembly 214*a* also may replace the toilet roll 246*a* in the prior art conventional wall holder, which would no longer be used as a result of device 130. In this case, a toilet roll standard wall arbor 252 could be inserted into tube body 215 (FIG. 28). The perfume tube assembly 214*a* could be purposely made aesthetically pleasing with this in mind. Various alternative configurations of perfume tube assembly 214*a* are possible without changing its operation. For example, FIG. 31 shows an alternative perfume tube assembly 214*b* in which the tube body 215 (FIG. 28) can be manufactured without the surface air holes 216 (FIG. 28), comprise a different shape, material, or any combination thereof.

The finish or decor of the complete dispensing stand 130 can be made available in multiple color designs to suit the users' preferences and would reflect the customary techniques of the craft finishing art. Further, as discussed above, commodities used and consumed in the dispensing stand 130 are commercially readily available.

However, in addition to these products, dispensing stand 130 could dispense one or more new products. For example, when the device 130 is used in a reception area, a child's bathroom, an elementary school setting, or other similar settings, one or more of the products dispensed by device 130 can comprise printed form products that include educational content and/or commercial content or the like as shown in FIGS. 32 and 35. In this manner, the dispensing stand 130 can be used for educational or commercial use. The attractiveness and the usefulness of the device 130 are beneficial qualities, which are enhanced by this embodiment. Further, it is clearly evident that if advertisements are printed on these paper products, the cost of those products or of the dispensing device 130 itself could be reduced drastically. Still further, if the device 130 is used in a school setting, or at home, educational information would reinforce the learning process for our children, an admirable and desirable concept. No change in the operation of device 130 is required with this different embodiment.

Figure 38:
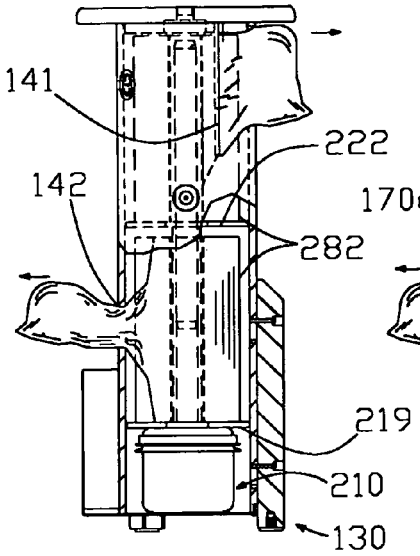
FIG. 38 is an elevation view showing the dual dispensing arrangement of a new product paper facial tissue rolls, and without the open roll holder assembly, the caster leg assemblies and the web tear plate assembly, also shows either the top or bottom product roll being a spare roll of facial tissues.
Figure 39:
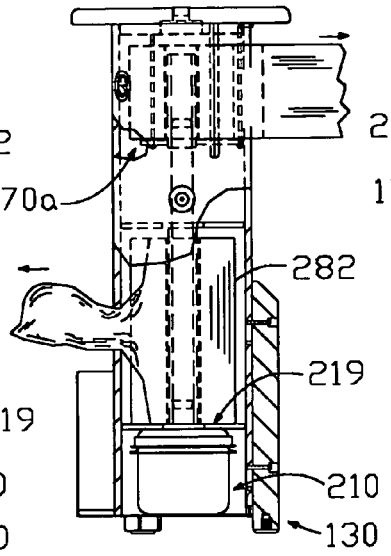
FIG. 39 is an elevation view showing the dispensing of a special facial tissue roll using holder and a toilet roll using the hanging roll holder, also without the open roll holder assembly, the caster assemblies and the web tear plate assembly.
Figure 45:
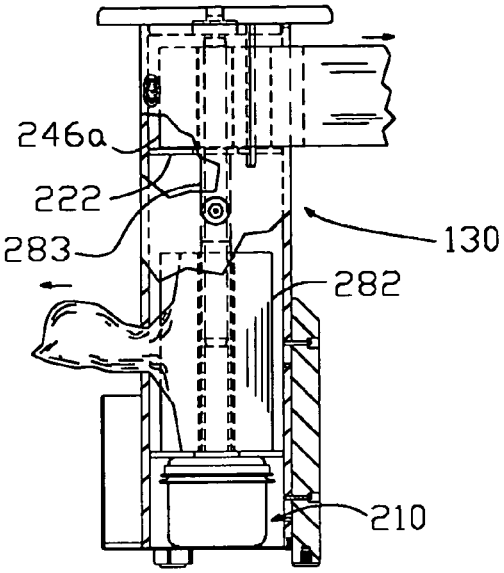
FIG. 45 is an elevation view showing the dispensing of a special facial tissue roll using enclosed lower roll holder and an enclosed upper roll holder for toilet roll use and the long tube spacer; also, without the open roll holder assembly, the caster leg assemblies and the web tear plate assembly.

As shown in FIGS. 38-39 and 45, another new product, facial tissue rolls 282 can also be dispensed using device 130. Facial tissue rolls 282 can measure approximately 4¾ inch nominal diameter×9 inch nominal length×a standard 1⅝ inch nominal core diameter. To this extent, facial tissue roll 282 can include perforations at approximately 4 inch nominal spacing. The dispensing operation for a paper facial tissue roll 282, specifically developed for dispensing in conjunction with this invention is herein shown. In particular, FIG. 38 shows the roll 282 dispensed from the lower holder 219 where the web goes through the housing feel and feed hole 142, and from the upper holder 222 where the web goes through the housing open slot 141. FIG. 39 shows the roll dispensed from the lower holder 219 with the upper holder 222 acting solely for support and stability. It may be noted that a toilet roll 246*a* is also being dispensed simultaneously in this dispensing arrangement using the hanging roll holder 170*a*. FIG. 45 shows another dispensing arrangement, in which the holder 170*a* (FIG. 39) is not used. Instead, the upper holder 222 with the long spacer 283 is used to dispense the toilet roll 246*a*.

The above specific preferred embodiments of the device 130, referring to the detailed description, drawings and depicted illustrations, along with the shown explanation of its principles, should not be construed as limiting the scope thereof. As some of the possible alternate embodiments shown in FIGS. 6-9, 17-18, and 29-37 illustrate, mere deviations in features that would be apparent to those skilled in the art would only encroach on the spirit of the embodiment disclosures.

To this extent, numerous modifications and variations can obviously be made without departing from the scope of the invention. The invention is only limited by the presented claims. The dispensing stand 130, with its plurality of parts, has the ability to change function or appearance. This is one of the claims of the invention, that is, its omnibus character. An example would be the ability to readily remove the caster leg assembly 185 (FIG. 2), or the open roll holder assembly 190 (FIG. 2). These omnibus functions are explained in the above description and operation of the invention. Other changes come under the definition or category of alternate embodiments, such as the different size and/or shape mini-table tops, different shapes of housing tubes, and the like. As a final discussion on alternate embodiments, the dispensing stand 130 can be offered in its entirety, and/or encompassing only some of its parts or functions, since its capability to revert back has not been diminished. Further, any additional part or function can be added, for example, a hole or recess in the table top surface of such size as to hold a drinking glass or cup.

It has been stated that the dispensing stand 130 disclosed herein provides an omnibus service device for dispensing commonly used paper products, either simultaneously, selectively, or in combination, while offering other conveniences such as item storage, device mobility, and time clock availability. The intended location for using the device 130 is also claimed multi-functional, that being, equally well suited in a bathroom, kitchen, living room, den, office, work-area or other similar area. The device 130 provides an attractive, mobile, and compact service stand, which offers total concealment of a plurality of inner dispensed products. The actual dispensing arrangement utilized and the location of use, are selectively determined by the user's requirements. As shown in FIG. 2 and throughout the Figures, aspects of the uniqueness of device 130 include the open and enclosed roll holders 190, 170*a*, 222, 219, which can dispense a web with several novel brake tension control features shown, and a novel web tear plate assembly 180*a* (FIG. 53), which tears a web with or without perforations, using a forever self renewable edge. This tear plate assembly 180*a* displays another unique quality since it holds the web vertically in place until the next usage. The objectives of the invention being satisfied by the specification and other details of the patent disclosure are herein given by the inventor.

Although the wide variety of embodiments shown illustrate many of the principles and features of the device 130, it is readily apparent and appreciated to those skilled in the art that numerous variations and minor modifications may be made without departing from the spirit of the detailed embodiments, which serve as illustrations only. Thus, the disclosure of the device 130, encompasses such variations and modifications which are intended to be included within the scope of the following claims and legal equivalents thereto.

Having set forth the detailed description and drawings of the best mode along with alternate embodiments of my invention "Multiple Type Paper Dispensing Mobile Stand with Mini-Table and Storage 130", I claim the above shown and anticipated embodiments as new and desire them to be protected by Letters Patent of the United States.

What is claimed is:

1. A stand for dispensing a paper product, the stand comprising:

a hollow elongate housing configured to be disposed in an upright position, wherein the elongate housing includes:

a first end configured to be a top surface when the elongate housing is disposed in the upright position;

a second end disposed opposite the first end;

a first elongate aperture disposed proximate the first end, wherein the first elongate aperture is configured to dispense the paper product; and a plurality of housing support grooves on the top surface; and a hanging roll holder configured to hold the paper product proximate the first elongate aperture, wherein the hanging roll holder comprises:

a base;

an arbor attached to an inner portion of the base; and a plurality of hanging supports that are each attached to an outer portion of the base and configured to set in one of the plurality of housing support grooves.

2. The stand of claim 1, further comprising a second aperture disposed proximate the second end, wherein the second aperture can dispense another paper product.

3. The stand of claim 1, further comprising a mini-table top configured to removably cover the top surface, wherein the mini-table top includes:

a substantially flat top surface; and a bottom portion configured to loosely engage an inside diameter of the housing at the top surface, wherein the bottom portion includes a plurality of locking flats to retain the plurality of hanging supports.

4. The stand of claim 3, further comprising an open roll holder assembly mounted to the mini-table top that is configured to dispense another paper product on the mini-table top.

5. The stand of claim 4, wherein the open roll holder assembly includes:

an open roll holder arbor;

a plurality of brake and alignment discs attached to the arbor; and a sheet unwind retainer rod.

6. The stand of claim 1, further comprising a web tear plate attached proximate to the first elongate aperture, wherein the web tear plate assists in tearing the paper product.

7. The stand of claim 6, wherein the web tear plate includes:

a web tear plate base attached to the hollow elongate member;

a substrate mounted to the web tear plate base, wherein the substrate includes a web tear plate abrasive, and wherein the substrate comprises an abrasive tear edge; and a web tear plate pick-up notch.

8. The stand of claim 1, wherein the arbor comprises a hollow interior configured to accept a handle of a plunger, and wherein the hollow elongate housing comprises a sufficient height to store three spare toilet paper rolls and the plunger while dispensing another toilet paper roll using the hanging roll holder.

9. The stand of claim 1, wherein the hanging roll holder further comprises a brake washer configured to be inserted over the arbor.

10. A stand for dispensing a paper product, the stand comprising:

a hollow elongate housing configured to be disposed in an upright position, wherein the elongate housing includes:

a first end configured to be a top surface when the elongate housing is disposed in the upright position;

a second end disposed opposite the first end;

a first elongate aperture disposed proximate the first end, wherein the first elongate aperture is configured to dispense the paper product in a vertical direction; and a web tear plate attached proximate to the first elongate aperture, wherein the web tear plate includes a web tear plate abrasive to assist in tearing and holding the dispensed paper product.

11. The stand of claim 10, wherein the web tear plate further includes:

a web tear plate base attached to the hollow elongate member; and a substrate mounted to the web tear plate base, wherein the substrate includes the web tear plate abrasive, and wherein the substrate comprises an abrasive tear edge.

12. The stand of claim 11, wherein a portion of the substrate overhangs the web tear plate base.

13. The stand of claim 11, wherein the web tear plate further includes a web tear plate pick-up notch.

14. The stand of claim 10, further comprising a perfume tube assembly.

15. The stand of claim 10, further comprising a hanging roll holder configured to hold the paper product proximate the first elongate aperture, wherein the hanging roll holder comprises:

a base;

an arbor attached to an inner portion of the base;

a brake washer configured to be inserted over the arbor; and a plurality of hanging supports that are each attached to an outer portion of the base.

16. The stand of claim 10, further comprising a mini-table top configured to removably cover the top surface.

17. The stand of claim 16, further comprising an open roll holder assembly mounted to the mini-table top that is configured to dispense another paper product on the mini-table top.

18. The stand of claim 10, further comprising:

a first holder that includes:

a spider base; and a hollow arbor; and a second holder that includes:

a spider base; and a second arbor, wherein the second arbor is configured to nest within the hollow arbor.

19. A stand for dispensing at least one paper product, the stand comprising:

a hollow elongate housing configured to be disposed in an upright position, wherein the elongate housing includes:

a first end configured to be a top surface when the elongate housing is disposed in the upright position; and a second end disposed opposite the first end;

a mini-table top configured to removably cover the top surface; and an open roll holder assembly mounted to the mini-table top, wherein the open roll holder assembly is configured to dispense a first paper product on the mini-table top, and wherein the open roll holder assembly comprises:

an open roll holder arbor;

a plurality of brake and alignment discs attached to the arbor; and a sheet unwind retainer rod.

20. The stand of claim 19, wherein the elongate housing further includes:

a first elongate aperture disposed proximate the first end, wherein the first elongate aperture is configured to dispense a second paper product in a vertical direction; and a second aperture disposed proximate the second end, wherein the second aperture is configured to dispense a third paper product.

21. The stand of claim 20, further comprising a web tear plate attached proximate to the first elongate aperture, wherein the web tear plate assists in tearing and holding the second paper product.

22. The stand of claim 21, wherein the web tear plate includes:

a web tear plate base attached to the hollow elongate member;

a substrate mounted to the web tear plate base, wherein the substrate includes a web tear plate abrasive, and wherein the substrate comprises an abrasive tear edge; and a web tear plate pick-up notch.

23. The stand of claim 20, further comprising a hanging roll holder configured to hold the second paper product proximate the first elongate aperture, wherein the hanging roll holder comprises:

a base;

an arbor attached to an inner portion of the base;

a brake washer configured to be inserted over the arbor; and a plurality of hanging supports that are each attached to an outer portion of the base.

24. The stand of claim 20, wherein the stand is configured to simultaneously dispense a paper towel roll, a toilet paper roll, and one of a facial tissue roll and a pop-up facial tissue box sheet.

25. The stand of claim 20, further comprising an inner storage container configured to align at least one of the second paper product and the third paper product for dispensing.

26. The stand of claim 19, further comprising:

a plurality of side legs attached to the hollow elongate housing proximate the second end;

a plurality of caster assemblies, wherein each caster assembly is attached to one of the plurality of side legs; and at least one of a bottom closure plate for substantially enclosing the second end and an outer storage basket for providing storage exterior to the hollow elongate housing.

27. The stand of claim 19, wherein the mini-table top includes:

a substantially flat top surface; and a bottom portion configured to loosely engage an inside diameter of the housing at the top surface.

28. A stand for dispensing a paper product, the stand comprising:

a hollow elongate housing configured to be disposed in an upright position, wherein the elongate housing includes:

a first end configured to be a top surface when the elongate housing is disposed in the upright position;

a second end disposed opposite the first end;

a first elongate aperture disposed proximate the first end, wherein the first elongate aperture is configured to dispense the paper product; and a plurality of housing rod grooves on the top surface; and a hanging roll holder configured to hold the paper product proximate the first elongate aperture, wherein the hanging roll holder comprises:

a base;

an arbor attached to a center portion of the base; and a plurality of hanging rods that are each attached to an outer portion of the base and configured to set in one of the plurality of housing rod grooves.

* * * * *